US007266327B2

(12) United States Patent
Mori et al.

(10) Patent No.: US 7,266,327 B2
(45) Date of Patent: Sep. 4, 2007

(54) IMAGE-FORMING DEVICE HAVING A REMOVABLE PROCESS CARTRIDGE

(75) Inventors: Hirotaka Mori, Ichinomiya (JP); Atsuo Hirose, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 110 days.

(21) Appl. No.: 10/895,912

(22) Filed: Jul. 22, 2004

(65) Prior Publication Data

US 2005/0025521 A1 Feb. 3, 2005

(30) Foreign Application Priority Data

Jul. 25, 2003 (JP) ..... 2003-280299
Jul. 25, 2003 (JP) ..... 2003-280305

(51) Int. Cl.
*G03G 15/00* (2006.01)
*G03G 21/18* (2006.01)

(52) U.S. Cl. ..... 399/111; 399/167

(58) Field of Classification Search ..... 399/111–114, 399/167

See application file for complete search history.

(56) References Cited

U.S. PATENT DOCUMENTS 6,405,004 B2 * 6/2002 Matsuzaki et al. ..... 399/111
2002/0159790 A1 * 10/2002 Noda et al. ..... 399/111

FOREIGN PATENT DOCUMENTS

JP A-07-325535 12/1995
JP A 10-254328 9/1998

* cited by examiner

*Primary Examiner*—David M. Gray
*Assistant Examiner*—Ryan Gleitz
(74) *Attorney, Agent, or Firm*—Oliff & Berridge, PLC

(57) ABSTRACT

A laser printer includes: a main casing with two side walls; lower guiding grooves formed in the side walls; a process cartridge that is guided by the guiding grooves to be mounted in or removed from the main casing; and a lever rotatably supported by a shaft mounted on the main casing at a position near the lower guiding groove in one side wall. When the lever is rotated, a protruding part provided on one end of the lever protrudes into the lower guiding groove and engages with a fixing boss provided on the process cartridge, thereby preventing the process cartridge from moving in a direction opposite the direction in which the cartridge is mounted in the main casing.

38 Claims, 21 Drawing Sheets

IMAGE-FORMING DEVICE HAVING A REMOVABLE PROCESS CARTRIDGE

BACKGROUND OF THE INVENTION

1. Field of the Invention

The present invention relates to an image-forming device such as a laser printer, and particularly to an electrophotographic image-forming device having a removable process cartridge.

2. Description of Related Art

Process cartridges employed in laser printers and other image-forming devices, such as those disclosed in Japanese unexamined patent application publication No. HEI-10-254328, are well known in the art. This type of process cartridge is configured of a photosensitive unit housing a photosensitive drum and a charger, and a developing portion including a developing roller and a toner cartridge accommodating a developer (toner). The process cartridge can be removed from a main casing of the image-forming device in order to perform maintenance, clear paper jams, or the like.

The process cartridge is inserted through an opening formed in the main casing and guided into the image-forming position by guiding rails formed on the inside of the main casing. A spring is provided in the main casing for pulling the process cartridge into the image-forming device. When the process cartridge is mounted in the main casing, the spring prevents the cartridge from stopping short of the image-forming position and fixes the cartridge in the correct position.

SUMMARY OF THE INVENTION

However, since the urging force of the spring guides the process cartridge to the ultimate image-forming position in the conventional device described above, the process cartridge is difficult to mount in and remove from the image-forming device. Specifically, when mounting the process cartridge, the user has to push on the cartridge hard enough to overcome the urging force of the spring. Particularly when the process cartridge is removed from the main casing, the spring applies resistance to the process cartridge by urging a protruding part provided on the side surface of the process cartridge in a direction opposite the direction of removal. As a result, the process cartridge cannot be easily removed. One idea for overcoming this problem is to decrease the urging force of the spring. However, a smaller urging force may result in the process cartridge not reaching the prescribed image-forming position. Further, since the spring has to be mounted near the guiding rails formed in the main casing, construction of the main casing becomes more complex due to the increased number of parts thereon.

In view of the above-described drawbacks, it is an objective of the present invention to provide an improved image-forming device having a simple construction and facilitating the mounting of a process cartridge in a main casing of the image-forming device and the smooth removal of the process cartridge therefrom. It is another object of the present invention to provide a process cartridge suitable for use in the image-forming device.

In order to attain the above and other objects, the present invention provides an image-forming device including: a main casing; a process cartridge; a cartridge gear; a drive gear; and a restricting portion. The process cartridge has a photosensitive body and is capable of being mounted in and removed from an image-forming position defined inside the main casing. The cartridge gear is disposed on the process cartridge and is provided to the photosensitive body. The drive gear is disposed on the main casing and is capable of engaging with the cartridge gear to transfer a driving force to the cartridge gear. The restricting portion is provided on the main casing and is capable of switching between a restricting position and a non-restricting position, the restricting portion at the restricting position restricting the process cartridge from moving out of the image-forming position in a direction opposite the mounting direction when the drive gear engages with the cartridge gear to transfer a driving force to the cartridge gear, the restricting portion at the non-restricting position canceling the restriction of movement on the process cartridge.

According to another aspect, the present invention provides an image-forming device including; a main casing; a process cartridge; a main casing cover; a drive gear; and a lever. The main casing has a pair of side walls, an image-forming position being defined in the main casing between the pair of side walls. The process cartridge has a photosensitive body and is capable of being mounted in or removed from the image-forming position. The process cartridge further has a cartridge gear that is provided on the process cartridge to drive the photosensitive body. The main casing cover is attached to the main casing and is capable of opening and closing over the main casing. The main casing cover opens over the main casing to allow the process cartridge to be mounted in and removed from the main casing. The drive gear is provided on the main casing and is capable of engaging with the cartridge gear and rotating in forward and reverse directions for transferring a driving force to the cartridge gear. Guiding grooves are formed in the side walls of the main casing. Each guiding groove is formed in a corresponding side wall. Each guiding groove guides the process cartridge to the image-forming position to mount the process cartridge to the image-forming position. Each guiding groove guides the process cartridge to be removed from the image forming position outside the main casing. The lever is supported on the main casing and is disposed adjacent to one guiding groove on at least one side wall. The lever has a restricting portion capable of being switched between a restricting position and a non-restricting position. The restricting portion is at the restricting position when the main casing cover is in a closed state, the restricting portion at the restricting position restricting the process cartridge from moving out of the image-forming position in a direction opposite the mounting direction when the drive gear rotates in the reverse direction. The restricting portion at the non-restricting position cancels the restriction of movement on the process cartridge.

According to another aspect, the present invention provides an image-forming device including: a main casing; a main casing cover; and a process cartridge. The main casing has an image-forming position therein. The main casing cover is attached to the main casing and is capable of opening and closing thereon. The process cartridge can be mounted in or removed from the image-forming position in the main casing. One of the process cartridge and the main casing cover has one of a protrusion-shaped contact member and a resilient contact member capable of contacting the protrusion-shaped contact member, and the other one of the process cartridge and main casing cover has the other one of the protrusion-shaped contact member and the resilient contact member. The protrusion-shaped contact member contacts the resilient contact member when the main casing cover is closed, pushing the process cartridge into the image-forming position.

According to another aspect, the present invention provides an image-forming device including: a main casing; a main casing cover; and a process cartridge. The main casing has an image-forming position therein. The main casing cover is attached to the main casing and is capable of opening and closing thereon, the main casing cover having a protrusion-shaped contact member. The process cartridge can be mounted in or removed from the image-forming position in the main casing, the process cartridge having a resilient contact member capable of contacting the protrusion-shaped contact member. The protrusion-shaped contact member contacts the resilient contact member when the main casing cover is closed, pushing the process cartridge into the image-forming position.

According to another aspect, the present invention provides a process cartridge capable of being mounted in or removed from an image-forming device by opening a main casing cover provided on a main casing of the image-forming device. The process cartridge includes: a photosensitive body; a developing unit; and a resilient contact member. The developing unit develops electrostatic latent images formed on the photosensitive body. The resilient contact member contacts a portion of the main casing cover when the process cartridge is mounted in the image-forming device and when the main casing cover is closed. The main casing cover contacts the resilient contact member, when the main casing cover is closed, thereby pushing the process cartridge to a predetermined position in the image-forming device.

BRIEF DESCRIPTION OF THE DRAWINGS

The above and other objects, features and advantages of the invention will become more apparent from reading the following description of the preferred embodiment taken in connection with the accompanying drawings in which:

FIG. 5(*b*) is a front view showing the process cartridge of FIG. 5(*a*);

FIG. 5(*c*) is a side view showing the process cartridge of FIG. 5(*a*);

FIG. 5(*d*) is a side illustration showing an outline shape of the process cartridge of FIG. 5(*a*);

FIG. 8(*b*) is a detailed view of a portion VIIIb in FIG. 8(*a*);

FIG. 8(*c*) is a detailed view of a portion VIIIc in FIG. 8(*a*);

FIG. 9(*b*) is a detailed view of a portion IXb in FIG. 9(*a*);

FIG. 9(*c*) is a detailed view of a portion IXc in FIG. 9(*a*):

FIG. 10(*b*) is a cross-sectional view, taken along a line Xb-Xb in FIG. 10(*a*), illustrating rounded edges of the protrusion-shaped contact member:

FIG. 11(*b*) is a side view showing the left side panel and the main casing cover in a closed state;

DETAILED DESCRIPTION OF THE PREFERRED EMBODIMENT

Figure 1:
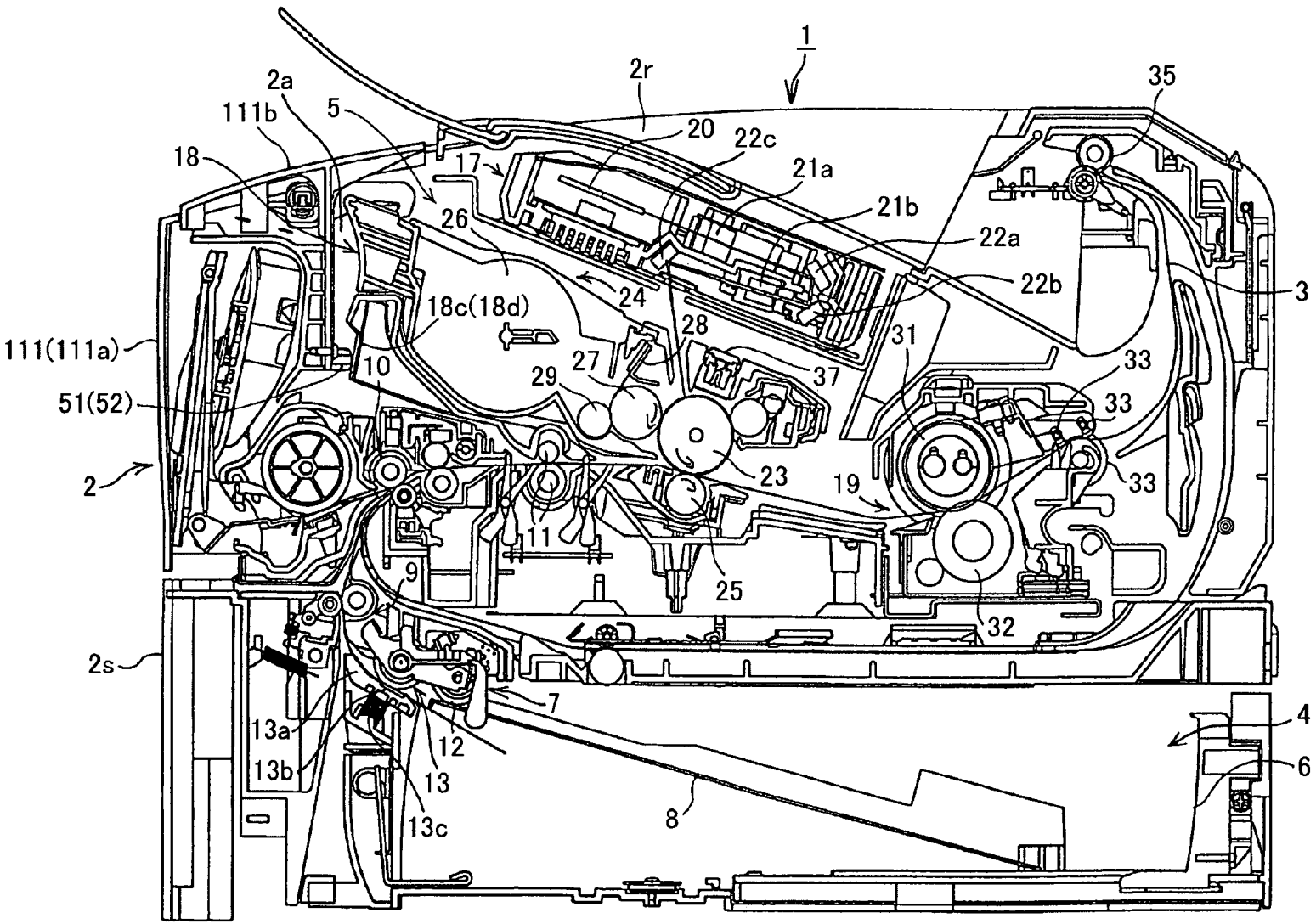
FIG. 1 is a side-cross-sectional view showing the general construction of a laser printer according to a preferred embodiment of the present invention.

An image-forming device according to a preferred embodiment of the present invention will be described while referring to the accompanying drawings wherein like parts and components are designated by the same reference numerals to avoid duplicating description.

A laser printer 1 according to the present embodiment has a configuration shown in FIG. 1.

In the following description, the expressions "front", "rear", "upper", "lower", "right", and "left" are used to define the various parts when the laser printer 1 is disposed in an orientation in which it is intended to be used.

The laser printer 1 is for forming images using an electrophotographic image forming technique. A feeder section 4 and an image forming section 5 are provided within a box-shaped main casing 2 of the laser printer 1. The feeder section 4 is for supplying sheets 3 (recording media). The image forming section 5 is for forming desired images on the supplied sheets 3.

FIG. 1 is a side cross-sectional view of the laser printer 1. In the following description, the left side in FIG. 1 will be referred to as the front of the laser printer 1, while the right side will be referred to as the rear of the laser printer 1. Further, the top side in FIG. 1 will be referred to as the top of the laser printer 1, while the bottom side will be referred to as the bottom of the laser printer 1. In addition, the near side in FIG. 1 will be referred to as the right side of the laser printer 1, while the far side will be referred to as the left side of the laser printer 1.

The feeder section 4 is located within the lower section of the main casing 2, and includes: a sheet supply tray 6, a sheet feed mechanism 7, a sheet pressing plate 8, a first transport portion 9, a second transport portion 10, and registration rollers 11. The sheet supply tray 6 is detachably mounted to the main casing 2. The sheet feed mechanism 7 is provided at one end of the sheet supply tray 6. The sheet pressing plate 8 is mounted in the sheet supply tray 6. The first transport portion 9 and second transport portion 10 are provided at positions downstream from the sheet feed mechanism 7 with respect to a sheet transport direction, in which sheets 3 are transported. The registration rollers 11 are provided downstream from the first transport portion 9 and the second transport portion 10 in the sheet transport direction.

The sheet supply tray 6 has a box shape with the upper side open so that a stack of sheets 3 can be housed therein. The sheet supply tray 6 can be moved horizontally into and out from the lower section of the main casing 2 so as to be detachable from the main casing 2.

The sheet feed mechanism 7 is of a friction-separating type and is provided with a sheet supply roller 12 and a separation pad 13. A support frame 13*a*, a pad 13*b*, and a spring 13*c* are disposed in confrontation with the separation pad 13.

The sheet pressing plate 8 is capable of supporting a stack of sheets 3 thereon. The sheet pressing plate 8 is pivotably supported at its end furthest from the sheet supply roller 12 so that the end of the sheet pressing plate 8 that is nearest to the sheet supply roller 12 can move vertically. Although not shown in the drawing, a spring for urging the sheet pressing plate 8 upward is provided to the rear surface of the sheet pressing plate 8. Therefore, the sheet pressing plate 8 pivots downward in accordance with increase in the amount of stacked sheets 3 on the sheet pressing plate 8. At this time, the sheet pressing plate 8 pivots around the end of the sheet pressing plate 8 farthest from the sheet feed mechanism 7, downward against the urging force of the spring.

Urging force of the spring under the sheet pressing plate 8 presses the uppermost sheet 3 on the sheet pressing plate 8 toward the supply roller 12. Rotation of the supply roller 12 pinches the uppermost sheet 3 between the supply roller 12 and the separation pad 13. Then, cooperative operation between the supply roller 12 and the separation pad 13 separates one sheet 3 at a time from the stack and supplies the sheet 3 to the image forming section 5.

The image forming section 5 includes; a scanner section 17, a process cartridge 18, and a fixing section 19.

The scanner section 17 is provided at the upper section of the main casing 2 and is provided with a laser emitting section (not shown), a rotatingly driven polygon mirror 20, lenses 21*a* and 21*b*, and reflection mirrors 22*a*, 22*b*, and 22*c*. The laser emitting section emits a laser beam based on desired image data. The laser beam passes through or is reflected by the polygon mirror 20, the lens 21*a*, and the reflection mirrors 22*a* and 22*b*, the lens 21*b*, and the reflection mirror 22*c* in this order so as to irradiate, in a high speed scanning operation, the surface of a photosensitive drum 23 of the process cartridge 18.

The process cartridge 18 is disposed below the scanner section 17 at a predetermined image-forming position as shown in FIG. 1. The process cartridge 18 is attachable to and detachable from the main casing 2. The process cartridge 18 is inserted via an opening 2*a* into the laser printer 1 in the rearward direction and is mounted in the image-forming position. The opening 2*a* is provided on the front section of the main casing 2, and is opened and closed by opening and closing a main casing cover 111 attached to the front section of the main casing 2. The process cartridge 18 has the photosensitive drum 23, a developing cartridge 24, a scorotron charge unit 37, and a transfer roller 25.

The developing cartridge 24 is attachable to and detachable from the process cartridge 18. The developing cartridge 24 is provided with a toner hopper 26. The developing cartridge 24 further includes: a supply roller 29, a developing roller 27, and a layer thickness regulating blade 28.

The toner hopper 26 is filled with toner as a developing agent.

Toner is supplied to the developing roller 27 by rotation of the supply roller 29. The toner slides against the layer thickness regulating blade 28, and is borne on the developing roller 27 in a thin layer of a fixed thickness.

The photosensitive drum 23 is in confrontation with the developing roller 27. The photosensitive drum 23 is rotatably supported in the process cartridge 18. More specifically, the photosensitive drum 23 is rotatably supported on a photosensitive drum shaft 18*b* (FIG. 5(*a*), 5(*c*), 5(*d*), 12), which is supported on the process cartridge 18. The photosensitive drum 23 includes a main body connected to ground and a surface portion formed from a photosensitive layer that is made from polycarbonate and that has a positively charging nature.

The scorotron charge unit 37 forms a positive charge uniformly on the surface of the photosensitive drum 23 as the photosensitive drum 23 rotates in the direction indicated by an arrow in FIG. 1. Then, the surface of the photosensitive drum 23 is exposed by high speed scan of the laser beam from the scanner section 17. As a result, an electrostatic latent image is formed on the photosensitive drum 23 based on the image data.

Next, a reverse developing process is performed. That is, when the electrostatic latent image formed on the photosensitive drum 23 is brought into contacting confrontation with the developing roller 27, the positively-charged toner borne on the surface of the developing roller 27 is supplied to the electrostatic latent image on the photosensitive drum 23. That is, the toner is supplied to the exposed area of positively charged surface of the photosensitive drum 23. The electric potential of the exposed area has been decreased by the laser beam exposure. As a result, the toner is selectively borne on the photosensitive drum 23 so that the electrostatic latent image is developed into a visible toner image.

The transfer roller 25 is disposed below the photosensitive drum 23 in confrontation with the photosensitive drum 23. The transfer roller 25 is made from a metal roller shaft covered by a roller made of conductive rubber material. At times of toner image transfer, a transfer bias is applied to the transfer roller 25 relative to the photosensitive drum 23. The visible toner image is borne on the surface of the photosensitive drum 23 is transferred onto the sheet 3 as the sheet 3 passes between the photosensitive drum 23 and the transfer roller 25. The sheet 3 on which the visible toner image has been transferred is transported to the fixing section 19.

The fixing section 19 is disposed in the rear side of the process cartridge 18. The fixing section 19 includes a thermal roller 31, a pressing roller 32, and three curl-removing rollers 33, which are provided in the rear side of the thermal roller 31 and the pressing roller 32. The thermal roller 31 is made from metal and is provided with a halogen lamp (heater). The toner which has been transferred onto the sheet of paper 3 in the process cartridge 18 is thermally fixed onto the sheet of paper 3 when the sheet of paper 3 passes between the thermal roller 31 and the pressing roller 32. Thereafter, the sheet of paper 3 is transferred by the curl-removing rollers 33 toward a discharge roller 35, which is provided to the main casing 2. The sheet of paper 3 is fed onto a discharge tray 2*r* by the discharge roller 35.

Figure 2:
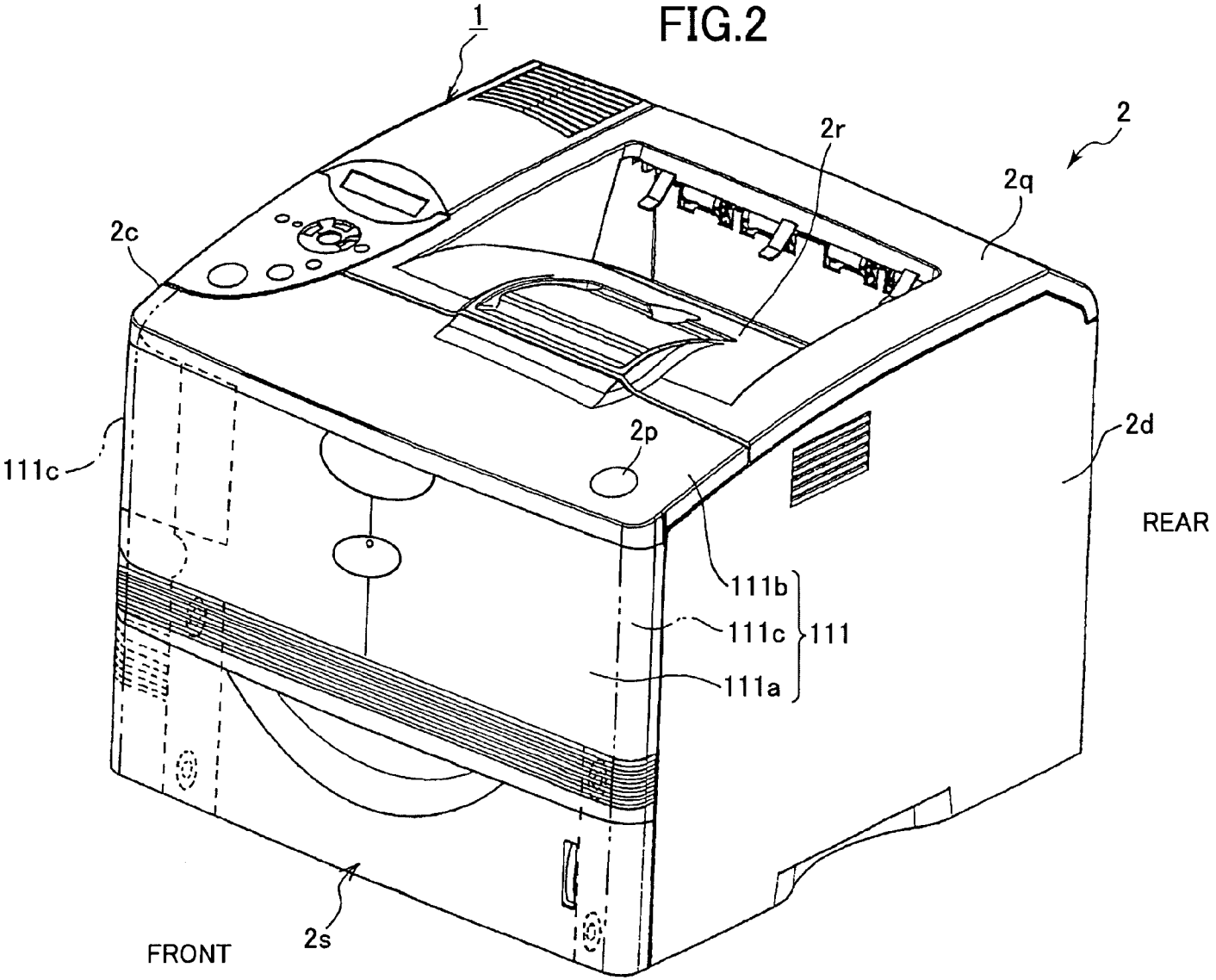
FIG. 2 is an external perspective view of the laser printer of FIG. 1.

As shown in FIG. 2, the main casing 2 includes: a left-side panel 2*c*: a right-side panel 2*d*; and an upper cover 2*q*, all of which are formed of resin. A main casing cover 111 is provided to the front side of the main casing 2. The main casing cover 111 is manipulated by a user to open and close the opening 2*a* (FIGS. 1 and 3) of the main casing 2.

The main casing cover 111 includes: a front portion 111*a*, an upper portion 111*b*, and left and right side portions 111*c*.

The front portion 111*a* covers the front surface of the laser printer 1. The upper portion 111*b* is formed in continuation with the front portion 111*a* and covers a part of the upper surface of the laser printer 1. The left and right side portions 111*c* are formed in continuation with the front portion 111*a* and cover parts of the left and right side surfaces of the laser printer 1.

The upper cover 2*q* is formed with a recess serving as a discharge tray 2*r*.

Figure 3:
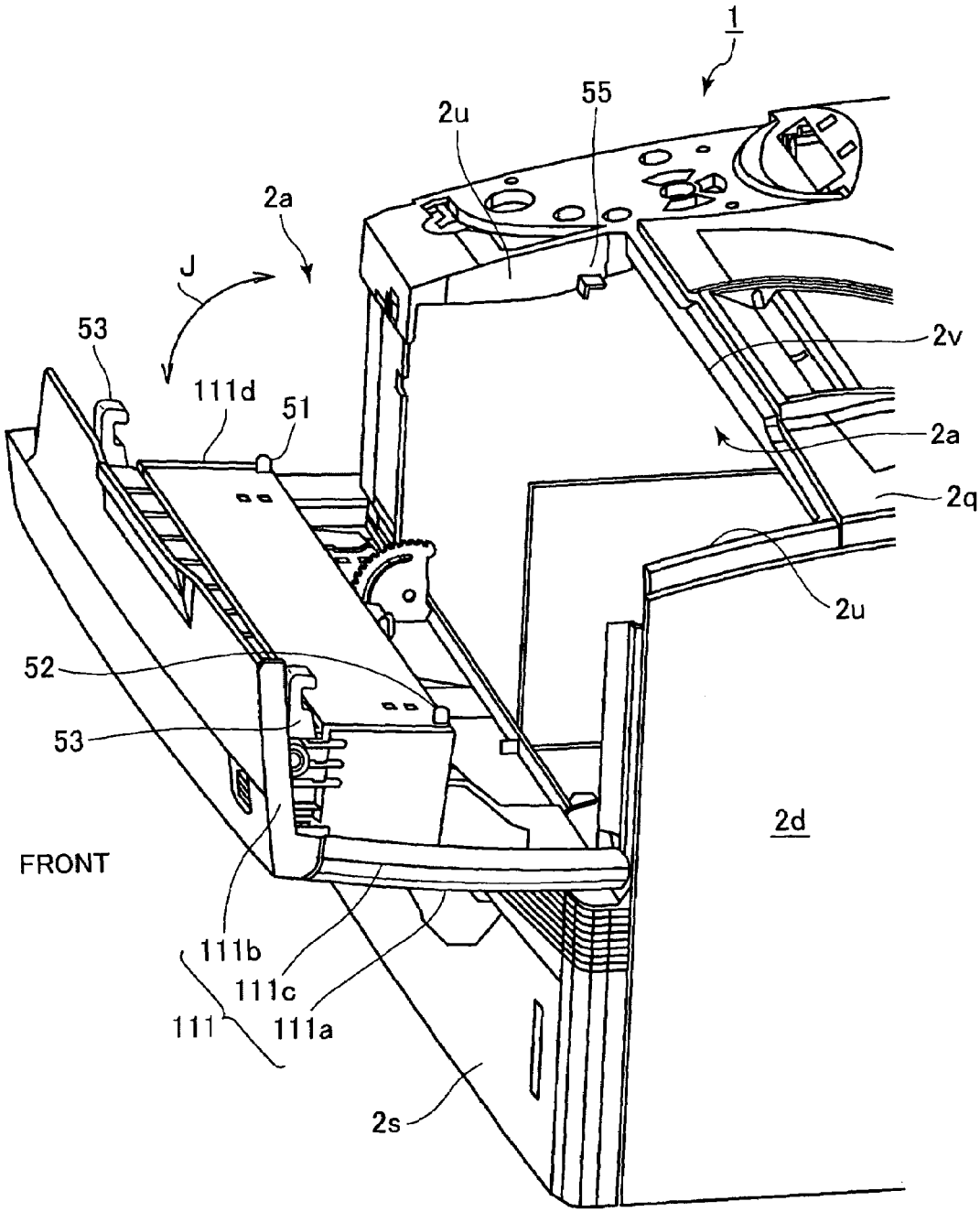
FIG. 3 is a perspective view of the laser printer of FIG. 1 wherein a main casing cover is opened.

When the main casing cover 111 is opened as shown in FIG. 3 from the closed state (FIG. 2), the opening 2*a* is formed in the front portion of the laser printer 1. As shown in FIG. 3, the opening 2*a* is surrounded by: the opened main casing cover 111: and left and right surfaces 2*u* and a rear surface 2*v* of the upper cover 2*q*. The rear surface 2*v* connects rear edge portions of the left and right surfaces 2*u*. When the main casing cover 111 is in the closed state of FIG. 2, the main casing cover ill covers the entire opening 2*a*. In this way, the main casing cover 111 can open and close the opening 2*a* on the front side of the main casing 2.

Figure 8A:
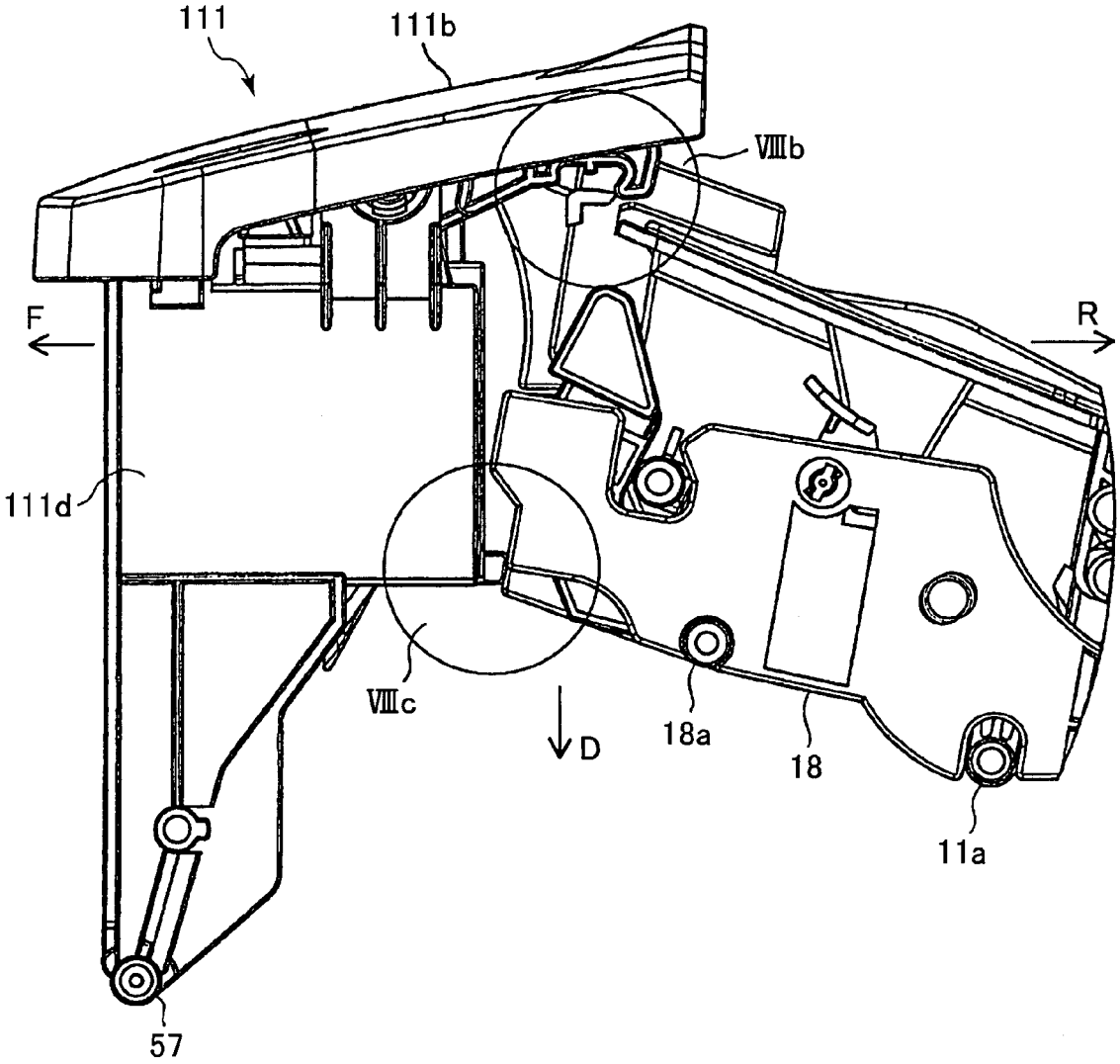
FIG. 8(*a*) is a side view showing a positional relationship between a main casing cover and the process cartridge when the main casing cover pushes the process cartridge.
Figure 8B:
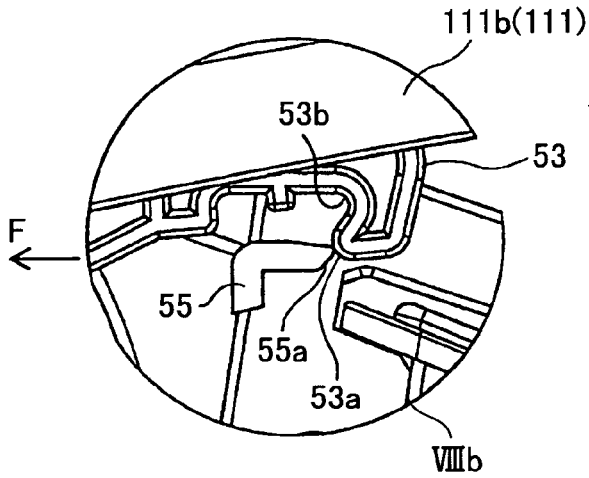
Figure 8C:
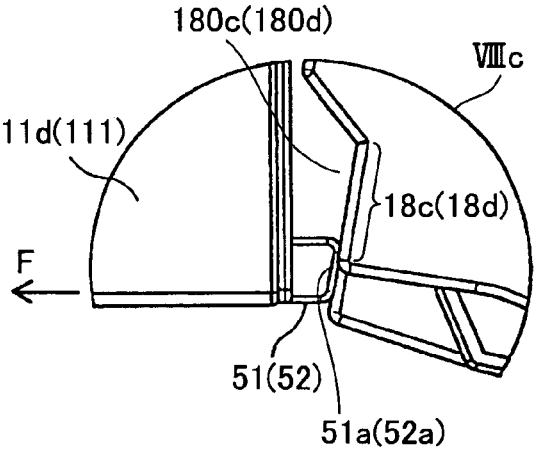

A shaft 57 (shown in FIG. 8(*a*)) is disposed at the lower end of the main casing cover 111 to extend in the horizontal direction. The main casing cover 111 is freely pivotable about the shaft 57 and opens and closes the opening 2*a* by moving in a direction J (FIG. 3). The process cartridge 18 can be inserted to and removed from the main casing 2 by opening the main casing cover 111.

As shown in FIG. 3, a casing cover base 111*d* is provided on the inner side of the main casing cover 111. A pair of protrusion-shaped contact members 51 and 52 are provided to the bottom end of the casing cover base 111*d* at left and right sides thereof.

The laser printer 1 further includes a first engagement mechanism (53, 55) for engaging the main casing cover 111 with the upper cover 2*q*. That is, the first engagement mechanism (53, 55) properly positions the main casing cover 111 relative to the top cover 2*q*.

The first engagement mechanism (53, 55) includes: a pair of engaging hooks 53 and a pair of engaging pawls 55. The engaging hooks 53 are provided on the inner surface of the main casing cover 111 at left and right sides thereof. More specifically, the engaging hooks 53 are provided to the top end of the casing cover base 111*d* at its left and right sides. Each engaging hook 53 has a substantially clamp shape extending along the inner surface of the upper portion 111*b*.

Figure 9A:
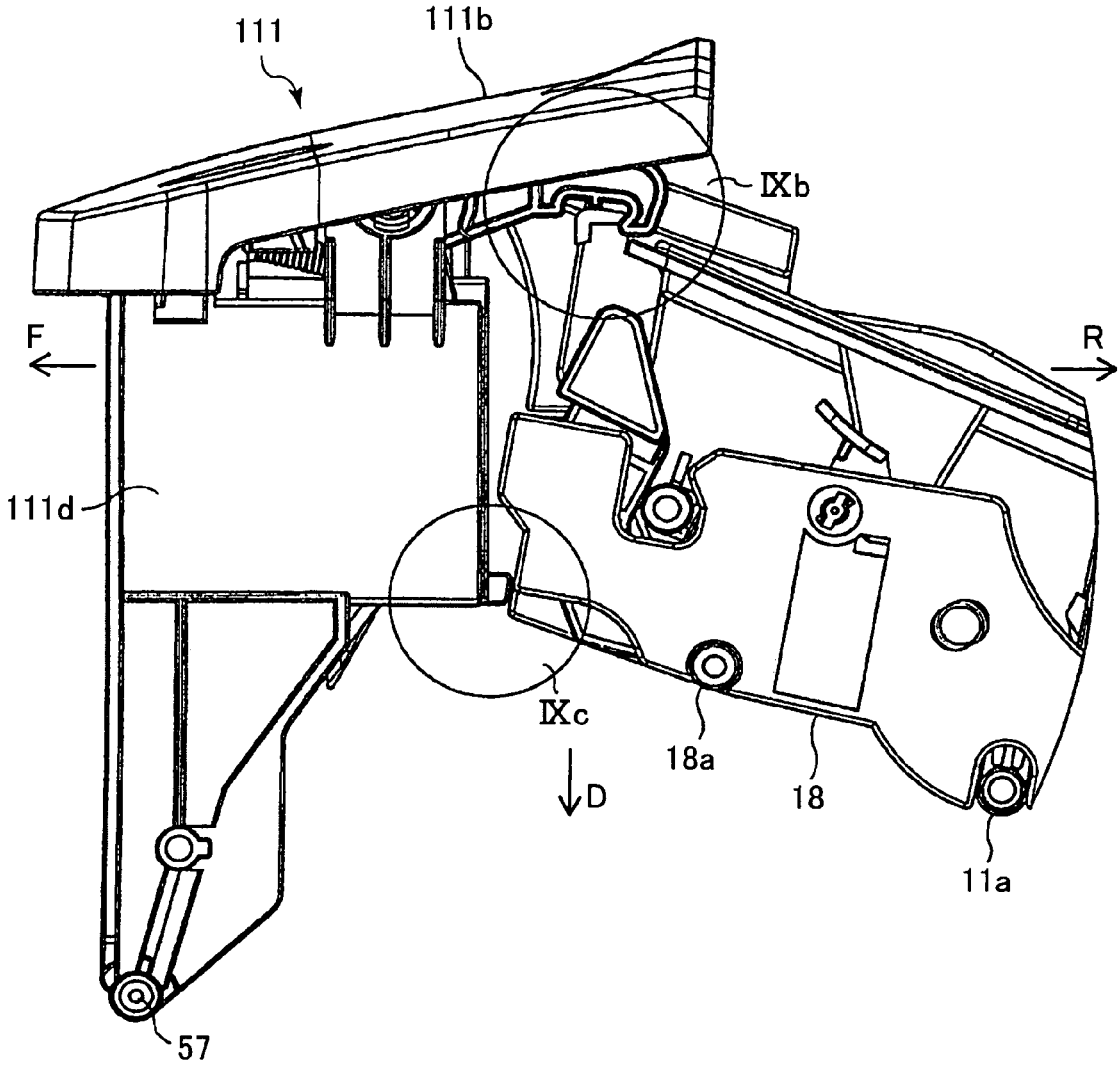
FIG. 9(*a*) is a side view showing a positional relationship between the main casing cover and the process cartridge when the process cartridge is mounted in the image-forming position.
Figure 9B:
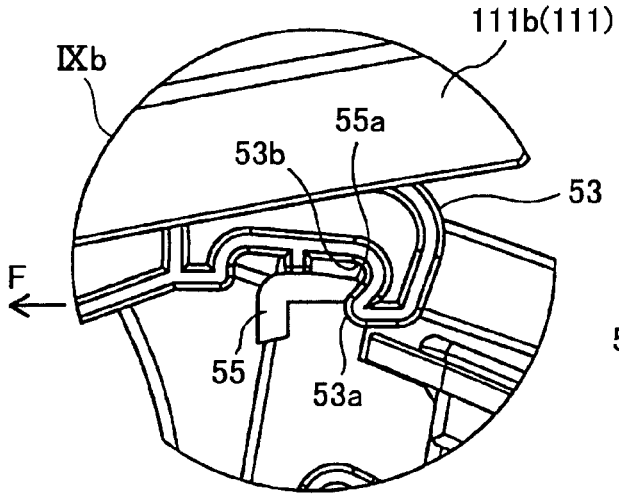
Figure 9C:
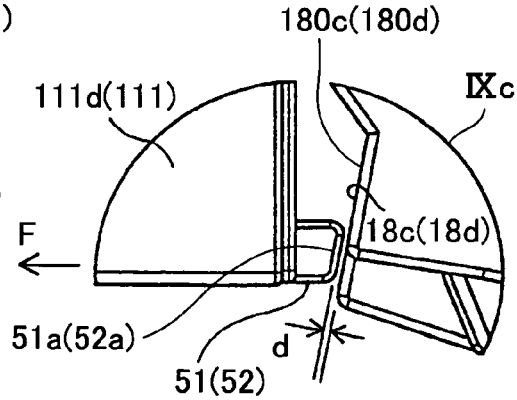

As shown in FIG. 3, the pair of engaging pawls 55 are protrusions provided on the left and right surfaces 2*u* of the top cover 2*q* and facing the opening 2*a*. When the main casing cover 111 is closed, each engaging pawl 55 engages with a recess (engaging recess 53*b* shown in FIG. 9(*b*)) of the corresponding engaging hook 53 as shown in FIG. 9(*a*) and FIG. 9(*b*).

As shown in FIG. 1, the sheet cassette 6 is located in the lower portion of the main casing 2. As shown in FIG. 1 and FIG. 2, the sheet cassette 6 has a front panel 2*s* that covers the front surface of the sheet cassette 6. The main casing cover 111 and the front panel 2*s* cooperate to serve as a front panel of the laser printer 1 when the main casing cover 111 is closed and the sheet cassette 6 is mounted in the main casing 2.

Figure 4:
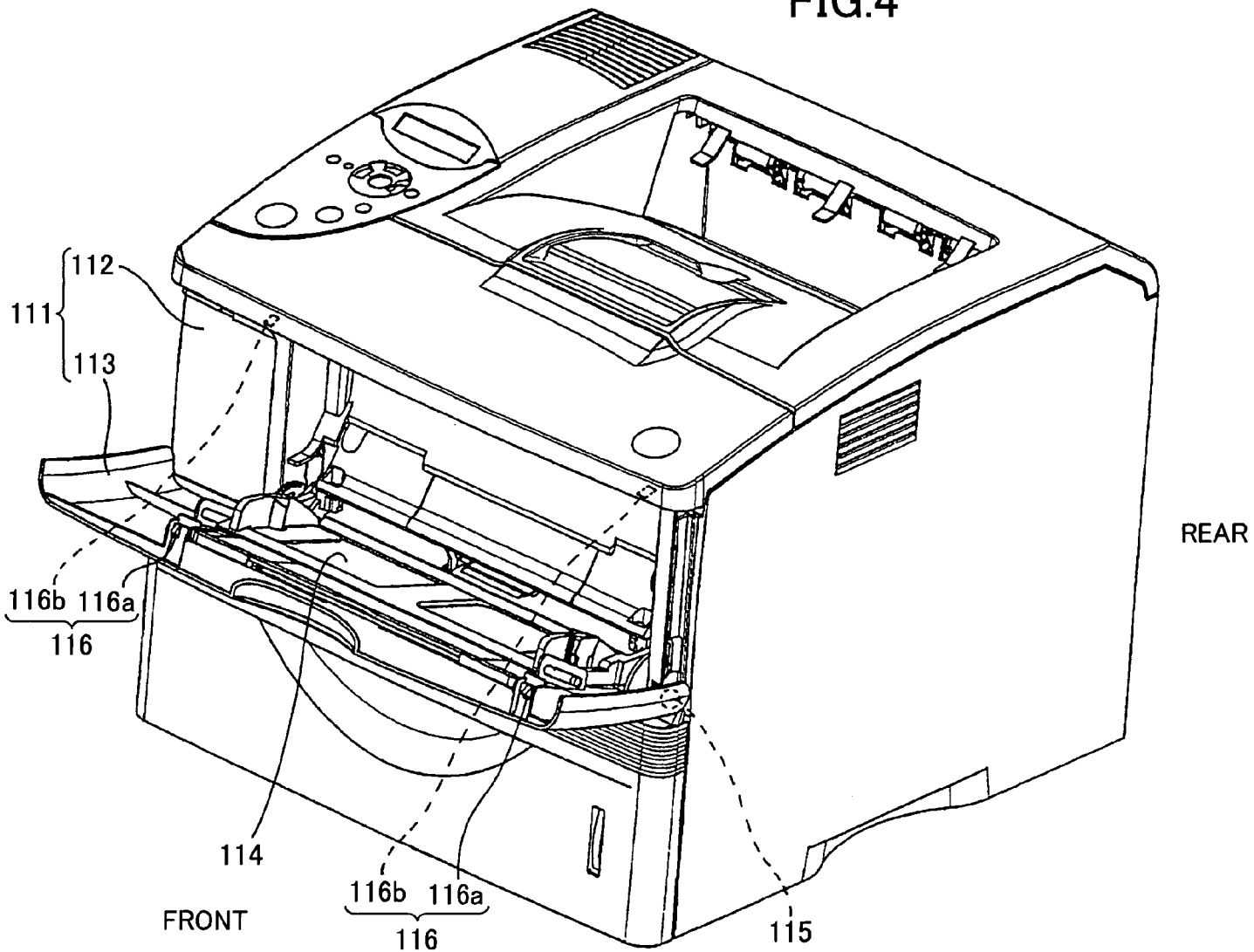
FIG. 4 is a perspective view of the laser printer of FIG. 1 when a tray cover of the main casing cover is open.
Figure 5B:
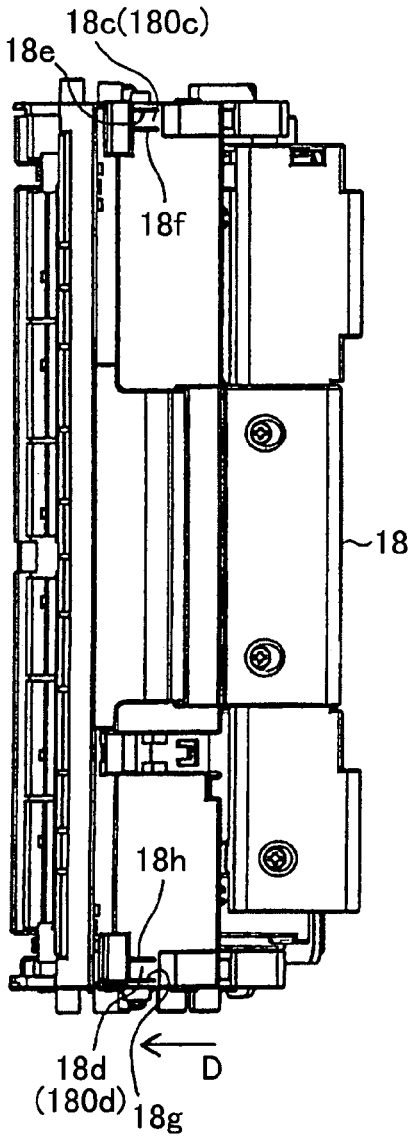
FIG. 5(*a*) is a plan view showing a process cartridge used in the laser printer.
Figure 5A:
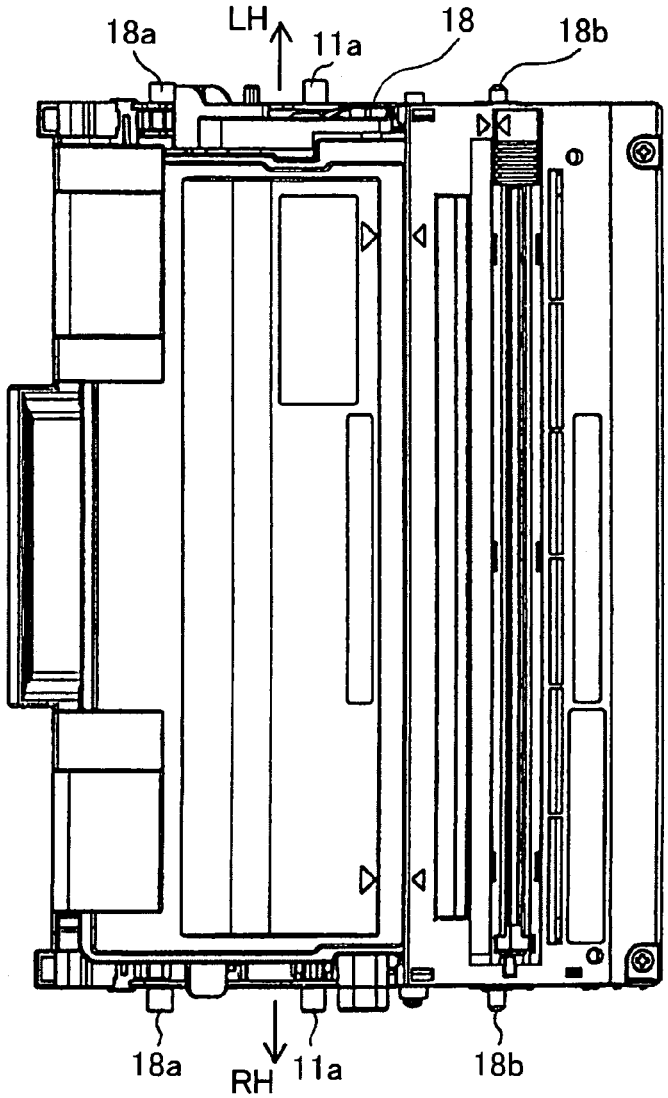
Figure 5C:
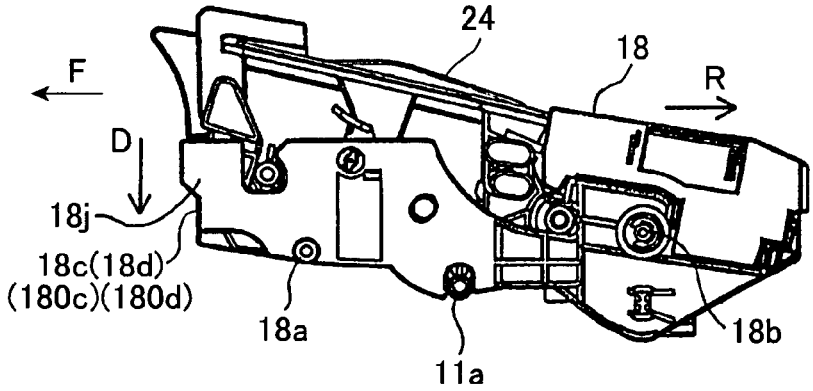
Figure 5D:
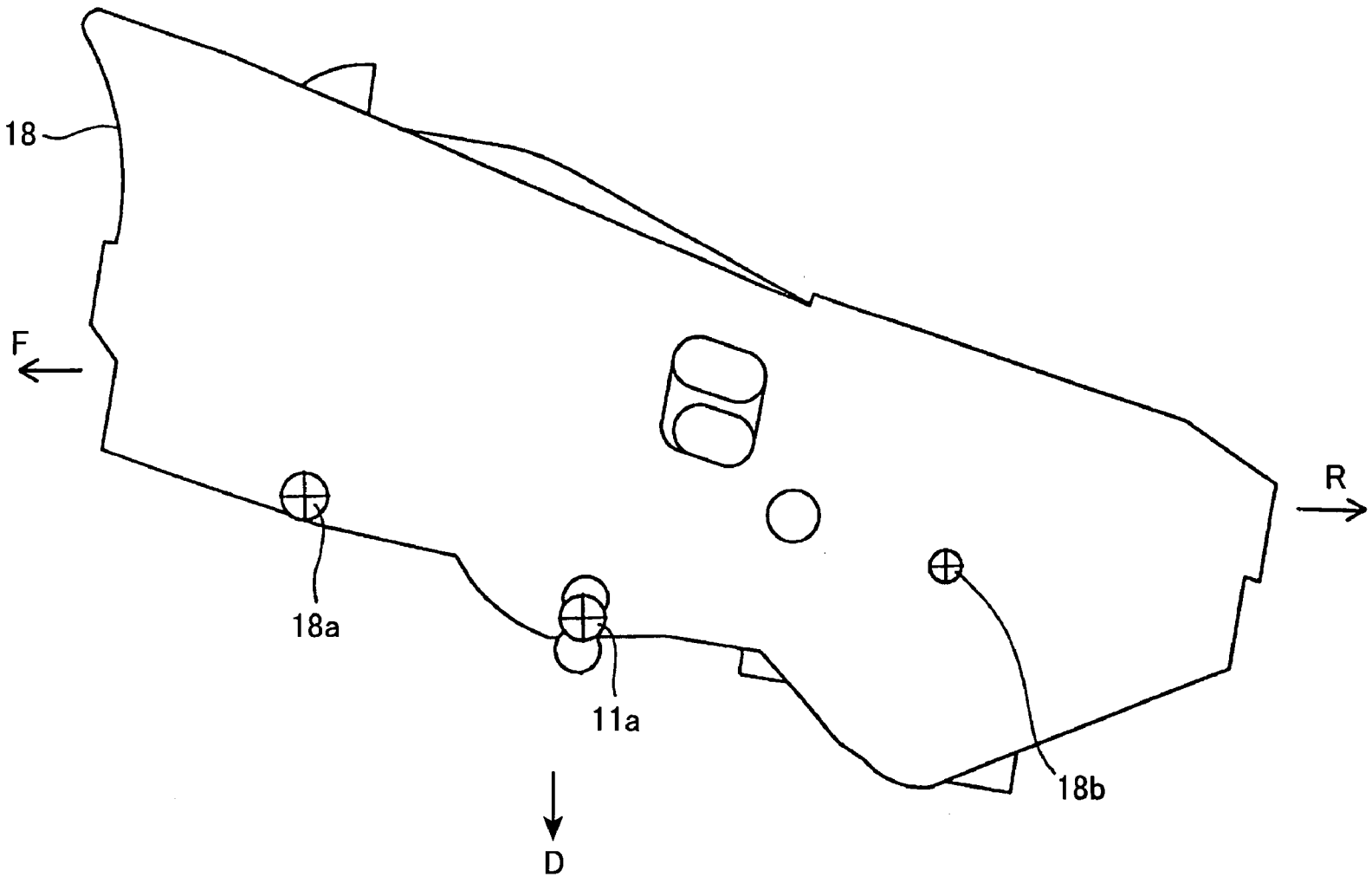

As shown in FIG. 4, the main casing cover 111 includes a main cover 112 and a tray cover 113. A rotational shaft 115 is disposed at the lower end of the main cover 112 to extend in the horizontal direction. The tray cover 113 is pivotably supported on the rotational shaft 115 such that the tray cover 113 can be opened and closed. That is, the tray cover 113 can pivot about the rotational shaft 115 such that its free end (upper end) moves upward and downward. The rotational shaft 115 could be the same shaft as the shaft 57 (FIG. 8(*a*)) of the main casing cover 111 or a separate shaft. A multi-purpose tray 114 is provided on the inner side of the tray cover 113 for holding a stack of paper.

As shown in FIG. 4, the laser printer 1 further includes a second engagement mechanism 116 for engaging the upper portion of the tray cover 113 with the main cover 112.

The second engagement mechanism 116 includes claws 116*a* and engagement members 116*b* for engaging with the respective claws 116*a*. The claws 116*a* are provided on an upper edge portion of the tray cover 113, and the engagement members 116*b* are provided on the main cover 112. Each claw 116*a* is a protrusion protruding upward from the upper edge of the tray cover 113, and each engagement member 116*b* has a recess that receives the corresponding claw 11*a*. A distance between the claws 116*a* or between the engagement members 116*b* is approximately the same as the width of the multi-purpose tray 114 in the lateral direction.

A portion of the upper edge of the tray cover 113 can bend slightly in the vertical direction. Therefore, when the claws 116*a* are engaged with the engagement members 116*b* so as to close the tray cover 113, the claws 116*a* are pressed slightly downward by the edge portion of the main cover 112, but the claws 116*a* return to the initial positions when engaged with the engagement members 116*b*, so that the claws 116*a* fit within the engagement members 116*b*. The second engagement mechanism 116 combines the tray cover 113 and the main cover 112 into the main casing cover 111.

As shown in FIG. 5(*c*), two resilient tongue-shaped contact members 18*c* and 18*d* are provided on the front surface of the process cartridge 18 facing the direction (F direction in FIG. 5(*c*)) opposite the mounting direction (R direction in FIG. 5(*c*)). More specifically, the process cartridge 18 has an outer panel 18*j*. The two resilient tongue-shaped contact members 18*c* and 18*d* are provided in the bottom portion (toward the D direction in FIG. 5(*c*)) of the outer panel 18*j* on the front surface thereof. By providing the resilient tongue-shaped contact members 18*c* and 18*d* on the bottom portion of the front surface rather than a side surface of the process cartridge 18, it is easier to create a mold for producing the process cartridge 18 provided with the tongue-shaped contact members. As shown in FIG. 5(*b*), the resilient tongue-shaped contact members 18*c* and 18*d* are disposed one on either left or right sides of the process cartridge 18 such that a line connecting the two contact members is level or horizontal.

As shown in FIG. 5(*b*), the resilient tongue-shaped contact member 18*c* is a flat rectangular piece, that is, a flexible tongue or reed piece, defined by a pair of vertical slits 18*e* and 18*f* formed in the bottom left portion of the front surface of the process cartridge 18, with the bottom end of the resilient tongue-shaped contact member 18*c* (in the D direction in FIG. 5(*b*)) being the free end. Similarly, the resilient tongue-shaped contact member 18*d* is a flat rectangular piece made by forming vertical slits 18*g* and 18*h* in the lower right portion on the front surface of the process cartridge 18 with the bottom end of the resilient tongue-shaped contact member 18*d* (in the D direction in FIG. 5(*b*)) being the free end. The resilient tongue-shaped contact members 18*c* and 18*d* are normally formed of a synthetic resin having flexibility and are formed integrally with the outer panel 18*j* of the process cartridge 18.

The resilient tongue-shaped contact members 18*c* and 18*d* have contact surfaces (front surfaces) 180*c* and 180*d* that face the direction F.

As shown in FIG. 5(*a*) and FIG. 5(*c*), the process cartridge 18 is provided with three pairs of protruding parts protruding from both sides of the process cartridge 18 in left and right directions (the RH and LH directions in FIG. 5(*a*)) that are orthogonal to the mounting or removing direction of the process cartridge 18 (F or R direction in FIG. 5(*c*)). These protruding parts are a photosensitive drum shaft 18*b*, a pinch roller shaft 11*a*, and a fixing boss 18*a*, which are arranged in this order with respect to the mounting direction (R direction) of the process cartridge 18. It is noted that as shown in FIG. 5(*d*), the pinch roller shaft 11*a* is capable of advancing from or retreating into the process cartridge 18 vertically.

As described already, the main casing 2 includes the side panel 2*c* on the left side and the side panel 2*d* on the right side as shown in FIG. 2.

Figure 6:
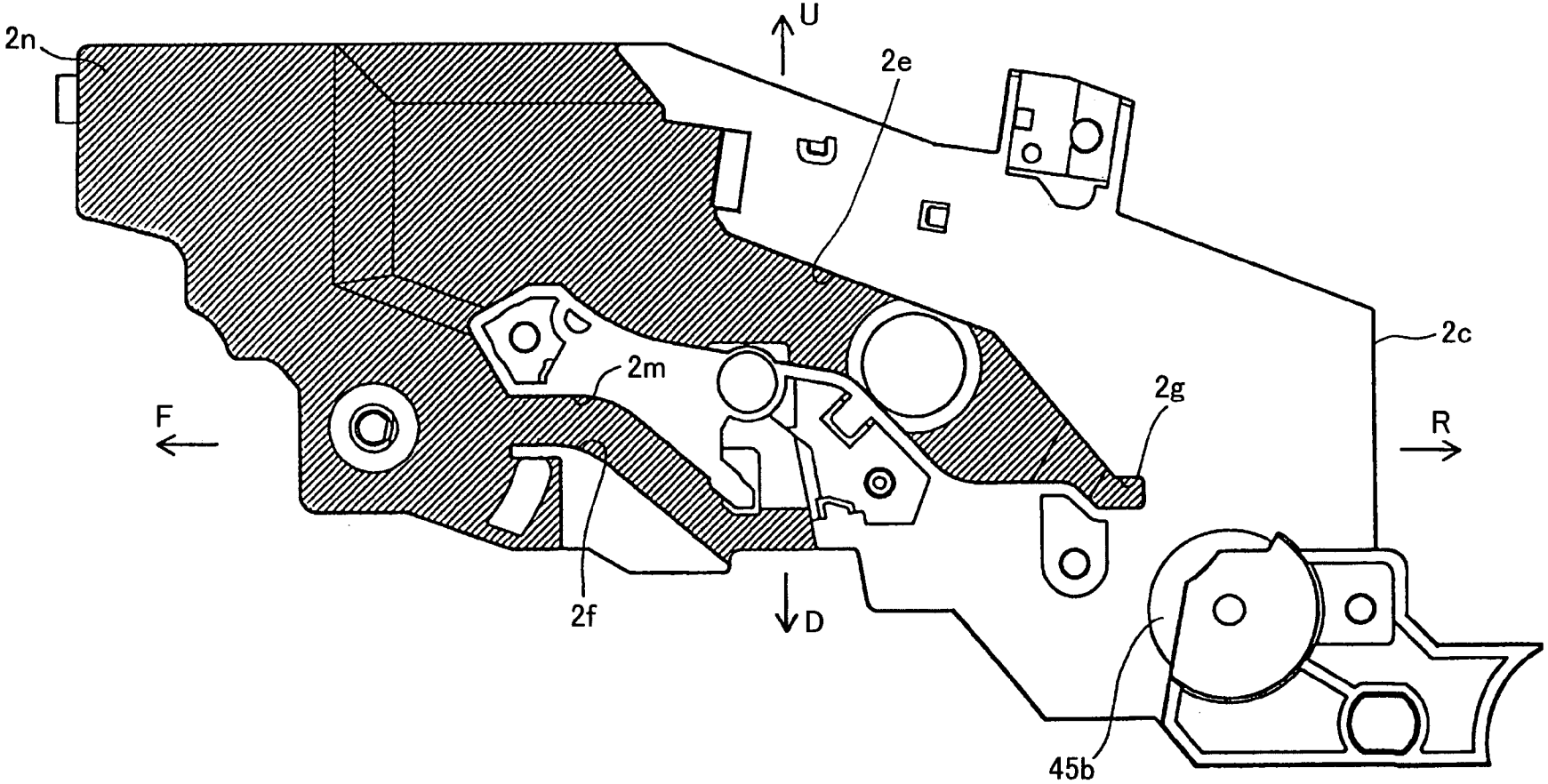
FIG. 6 is a side view showing the shape of guiding grooves formed in the inner side of a left side panel of a main casing of the laser printer.

As shown in FIG. 6, a guiding groove 2*n* is formed on the inside of the side panel 2*c*. The guiding groove 2*n* is for guiding the process cartridge 18 to the predetermined image-forming position in the main casing 2. The guiding groove 2*n* is indicated by hatch lines in FIG. 6. The guiding groove 2*n* is also formed in the side panel 2*d* on the opposite side (right side) from the side panel 2*c*. However, since the formation of the side panel 2*d* is identical to that of the side panel 2*c*, only the side panel 2*c* on the left side will be described herein.

The guiding groove 2*n* extends nearly linearly along the mounting direction of the process cartridge 18 (R direction in FIG. 6) along the horizontal direction, and subsequently branches into two guiding grooves, which are arranged vertically (U and D directions in FIG. 6). The two guiding grooves are an upper guiding groove 2*e* and a lower guiding groove 2*f*. The upper guiding groove 2*e* and the lower guiding groove 2*f* extend rearwardly. The upper guiding groove 2*e* is longer than the lower guiding groove 2*f* and includes a terminal guiding groove (terminal passage) 2*g* extending horizontally at the rear end thereof. The process cartridge 18 is inserted through the opening 2*a*, which is located at the front end of the side panel 2*c*, and is guided to the image-forming position in a single horizontal-directional motion along the guiding groove 2*n*, upper guiding groove 2*e*, and lower guiding groove 2*f* provided in the side panel 2*c*. Accordingly, it is easy for a user to insert the process cartridge 18 in the laser printer 1 and to mount the process cartridge 18 in the image-forming position.

Figure 7A:
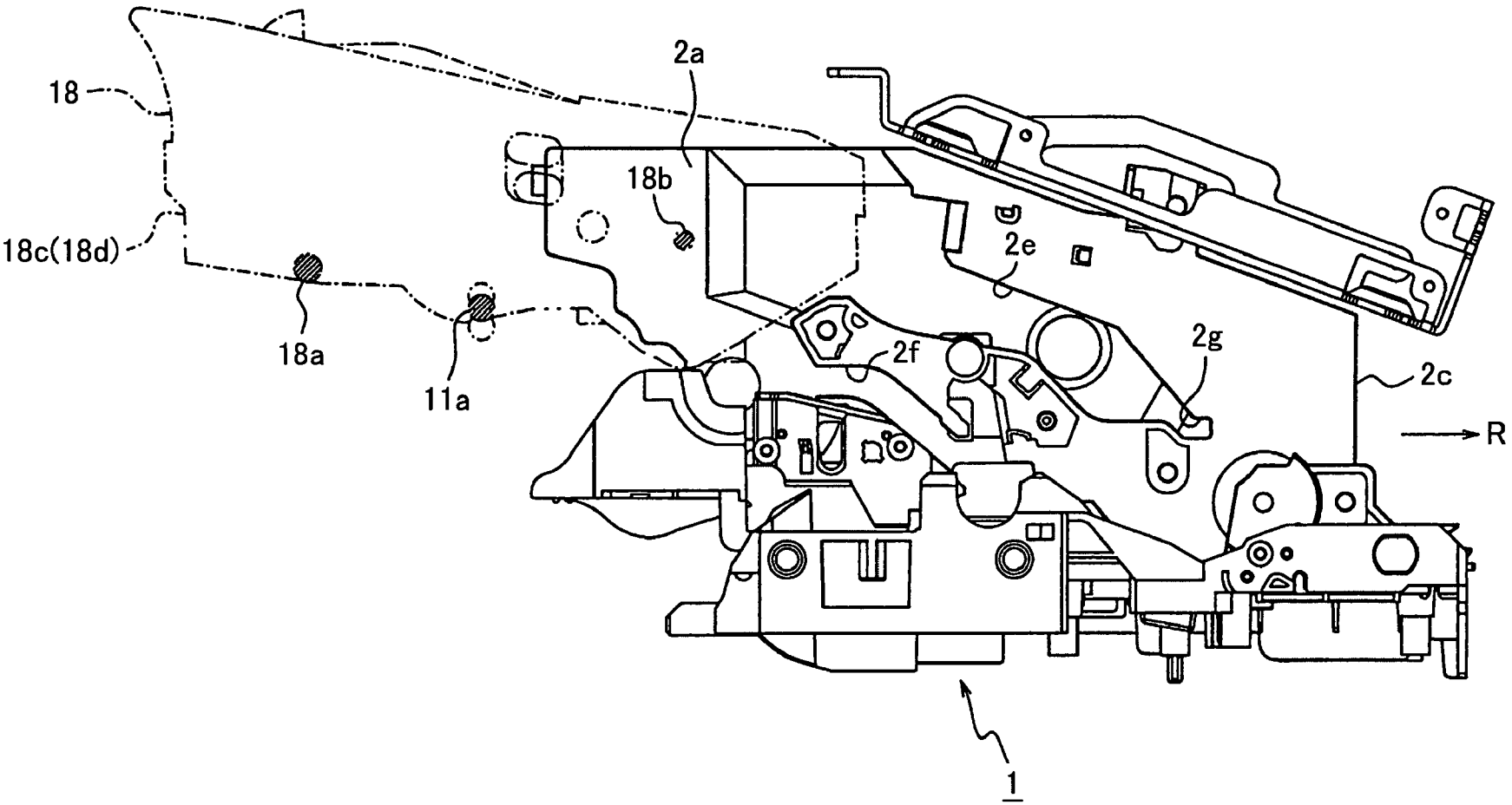
FIG. 7(*a*), FIG. 7(*b*), and FIG. 7(*c*) are side views showing the mounting passage, along which the process cartridge is mounted in the main casing of the laser printer, wherein FIG. 7(*a*) shows the state before the process cartridge is mounted in the main casing, FIG. 7(*b*) shows the state when the process cartridge is being inserted into the main casing, and FIG. 7(*c*) shows the state when the process cartridge is mounted in an image-forming position within the main casing.
Figure 7B:
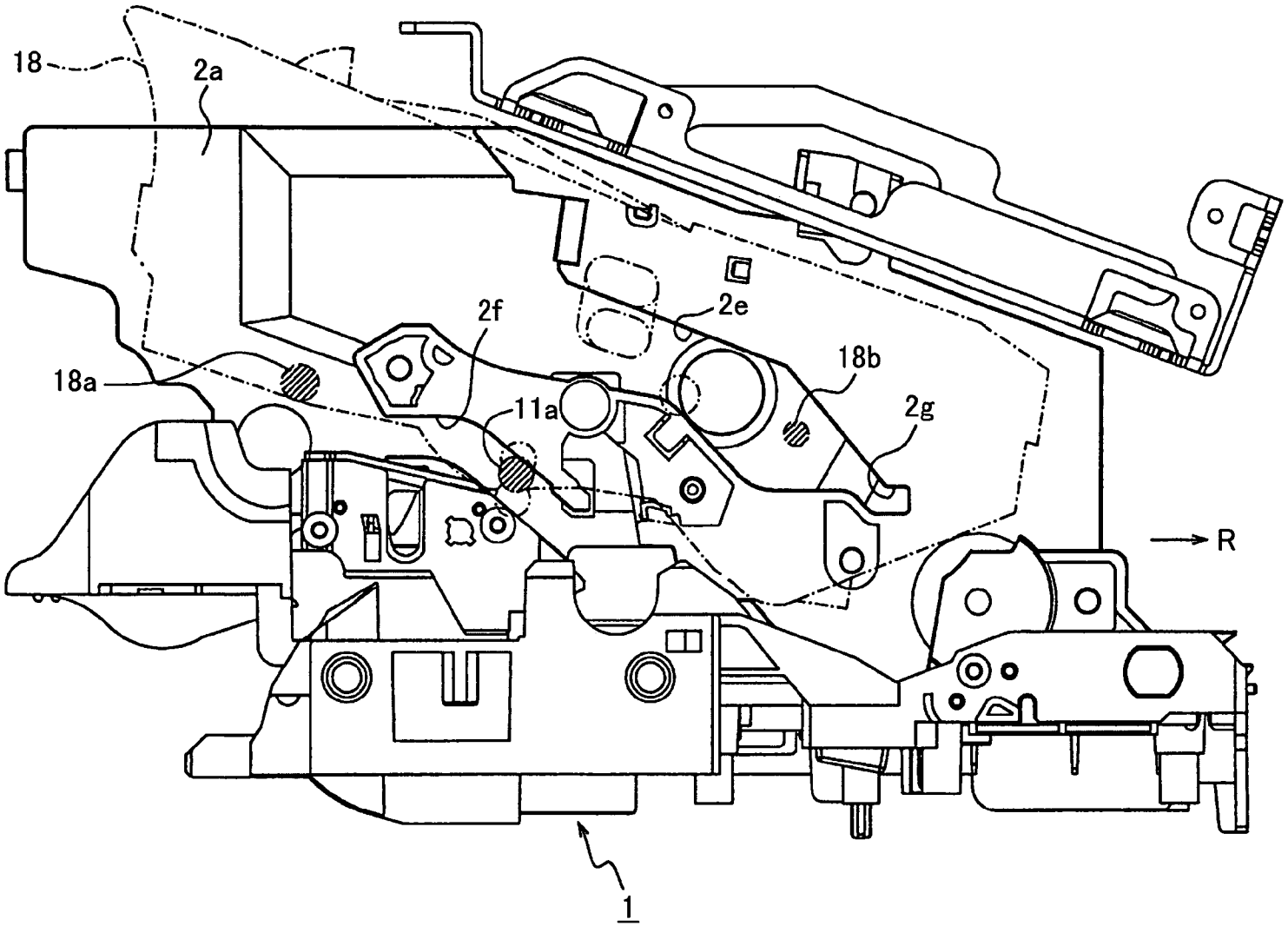
Figure 7C:
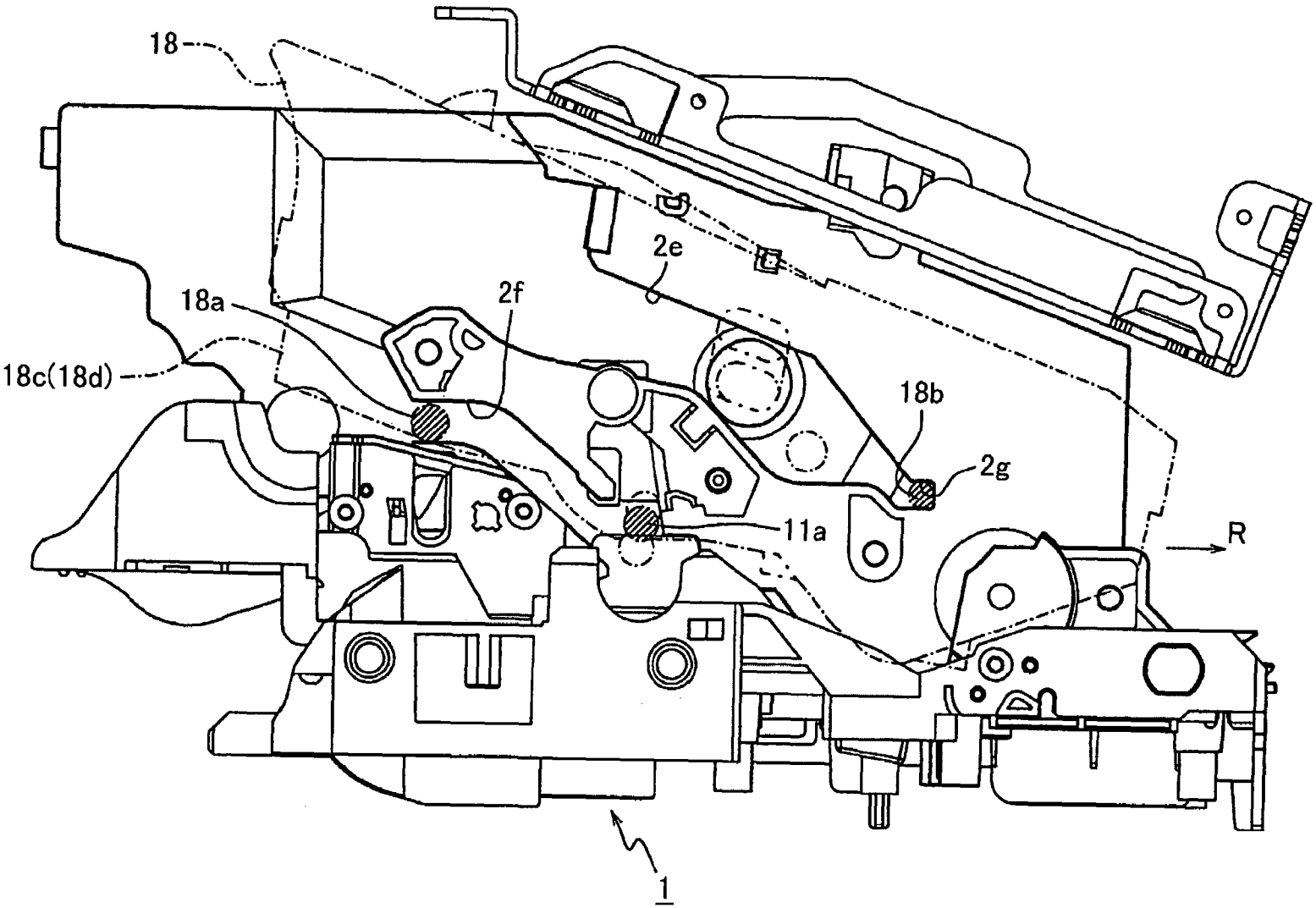

With reference to FIG. 7(*a*), FIG. 7(*b*), and FIG. 7(*c*), next will be described how the process cartridge 18 is guided by the upper guiding groove 2*e*, the lower guiding groove 2*f*, and the terminal guiding groove 2*g* on the side panel 2*c* to the image-forming position in the main casing 2.

As described above, the guiding grooves 2*e* and 2*f* extend from the opening 2*a* to the rear side of the laser printer 1. The terminal guiding groove 2*g* extends horizontally from the rear end of the guiding groove 2*e* further rearwardly. Accordingly, near the image forming position, the process cartridge 18 can be properly positioned at the image forming position simply by pushing the process cartridge 18 horizontally.

The upper guiding groove 2*e* and lower guiding groove 2*f* and the terminal guiding groove 2*g* are formed for guiding the process cartridge 18 into the image-forming position while maintaining the process cartridge 18 in a substantially level or horizontal mounting state. With this construction, the process cartridge 18 can be guided to the image-forming position with a single motion in a substantially horizontal direction, without depending on the weight of the process cartridge 18.

More specifically, as shown in FIG. 7(*a*), the process cartridge 18 is inserted in the laser printer 1 through the opening 2*a*, and is moved along the guiding grooves 2*e* and 2*f* in the direction R. As shown in FIG. 7(*b*), the photosensitive drum shaft 18*b* is guided along the upper guide groove 2*e*, while the pinch roller shaft 11*a* and the fixing boss 18*a* are guided along the lower guide groove 2*f*. The process cartridge 18 is then pushed rearwardly along the horizontal terminal guiding groove 2*g* toward the image-forming position. As a result, as shown in FIG. 7(*c*), the photosensitive drum shaft 18*b* reaches the rear end of the terminal guiding groove 2*g*.

FIG. 8(*a*) shows the positional relationship between the main casing cover 111 and the process cartridge 18 when the main casing cover 111 pushes on the process cartridge 18. At this time, the casing cover base 111*d* is located on the lower side (toward the D direction in FIG. 8(*a*)) of the upper portion 111*b* of the main casing cover 111. Each engaging hook 53, provided to the casing cover base 111*d*, is disposed on the rear end (toward the R direction in FIG. 8) of the casing cover base 111*d*.

As shown in FIG. 8(*b*), which is the detailed view of the portion VIIIb in FIG. 8(*a*), the engaging hook 53 has a hook end portion 53*a* and the engaging recess or depression 53*b* which is formed continuously with the hook end portion 53*a*. The engaging hook 53 may either be formed separately from the casing cover base 111*d* of the main casing cover 111 and later bonded to the casing cover base 111*d* by an adhesive or the like or may be formed integrally with the casing cover base 111*d*.

In FIG. 8(*a*), the protrusion-shaped contact members 51 and 52 are provided to the bottom end on the rear surface (toward the R direction in FIG. 8(*a*)) of the casing cover base 111*d*. The protrusion-shaped contact members 51 and 52 are disposed one on either side (left or right side) of the casing cover base 111*d* in the left-and-right direction that is orthogonal to the forward-and-rearward direction in which the main casing cover 111 moves.

The support shaft 57 is mounted in the main casing 2 so as to extend parallel to a straight line (horizontal line) that connects the resilient tongue-shaped contact members 18*c* and 18*d* in the process cartridge 10, which is mounted in the main casing 2, as shown in FIG. 8(*a*).

Each protrusion-shaped contact member 51, 52 is a protrusion substantially of a rectangular parallelepiped shape, and protrudes rearward (R direction in FIG. 8(*a*)) from the rear surface of the casing cover base 111*d*. As shown in FIG. 8(*c*), which is the detailed view of the portion VIIIc in FIG. 8(*a*), the protrusion-shaped contact members 51 and 52 are located at positions opposing the resilient tongue-shaped contact members 18*c* and 18*d* that are provided on the lower portion of the front surface of the process cartridge 18. The protrusion-shaped contact members 51 and 52 may be formed integrally with the casing cover base 111*d* or may be constructed separately from the casing cover base 111*d* and later bonded to the casing cover base 111*d* by adhesive or the like.

The protrusion-shaped contact members 51 and 52 have contact surfaces (rear surfaces) 51*a* and 52*a* that face in the mounting direction (rear direction R) and that extend substantially vertically in the state of FIG. 8(*a*)-8(*c*). In the state of FIGS. 8(*a*)-8(*c*), the contact surfaces (front surfaces) 180*c* and 180*d* of the resilient tongue-shaped contact members 18*c* and 18*d* in the process cartridge 18 face the removing direction (forward direction F). The main casing cover 111 is rotatable around the support shaft 57. Thus, the bottom end of the casing cover base 111*d* is also rotatable around the support shaft 57. When the main casing cover 111 rotates from the opened state shown in FIG. 3 to the state of FIG. 8(*a*)-8(*c*) where the contact surfaces 51*a* and 52*a* of the protrusion-shaped contact members 51 and 52 come into contact with the contact surfaces (front surfaces facing the forward direction F) 180*c* and 180*d* of the resilient tongue-shaped contact members 18*c* and 18*d* and pushes the process cartridge 18, the main casing cover 111 is oriented at such an angular position that the contact surfaces 51*a* and 52*a* of the protrusion-shaped contact members 51 and 52 are in parallel with the contact surfaces 180*c* and 180*d* of the resilient tongue-shaped contact members 16*c* and 18*d*. At this time, the entire portion of the contact surface 51*a*, 52*a* of each protrusion-shaped contact member 51, 52 is not in contact with the contact surface (front surface) 180*c*, and 180*d* of the corresponding resilient tongue-shaped contact members 18*c* and 18*d*. However, only a portion of the contact surface 51*a*, 52*a* of each protrusion-shaped contact member 51, 52 is in contact with the contact surface (front surface) 180*c*, 180*d* of the corresponding resilient tongue-shaped contact members 18*c* and 18*d*. It is noted that the strength of the protrusion-shaped contact members 51, 52 can be increased by increasing the areas of the contact surfaces 51*a* and 52*a*.

Figure 10A:
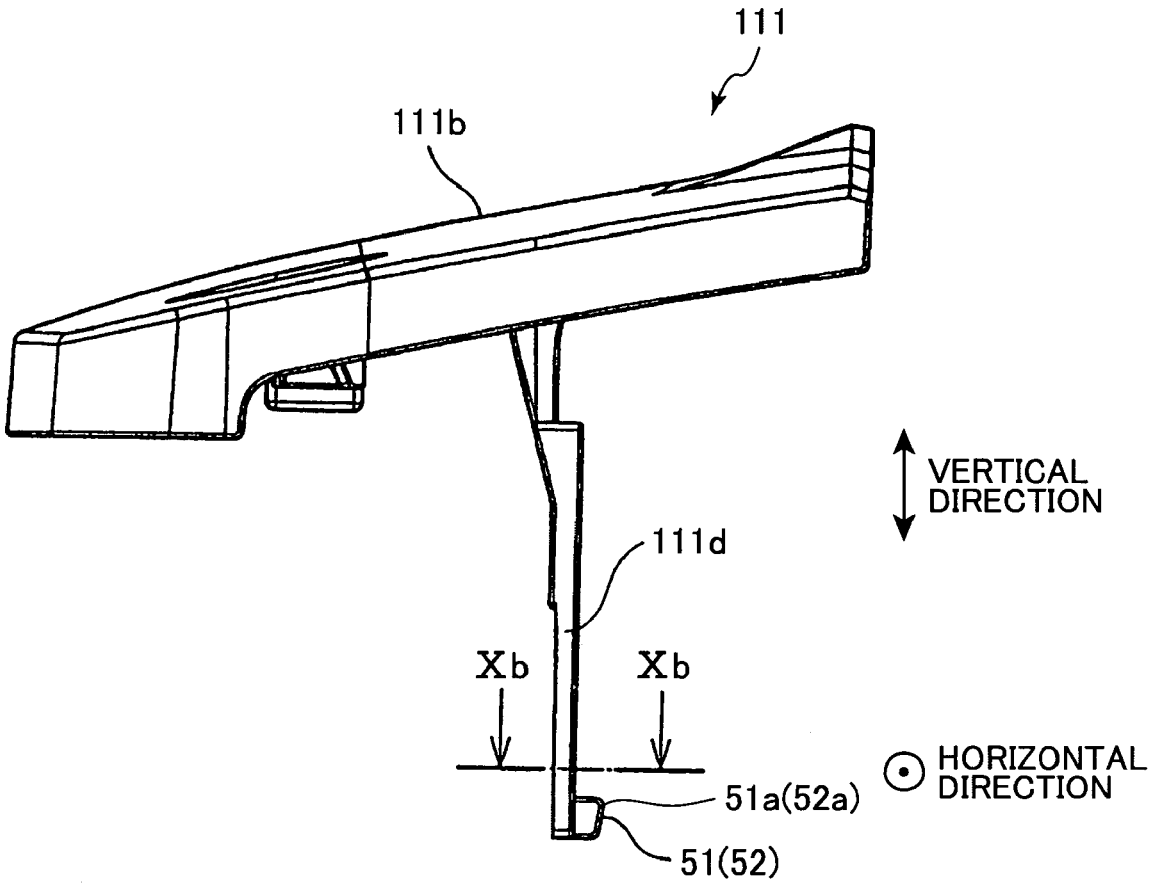
FIG. 10(*a*) is a side view showing a protrusion-shaped contract member provided to the main casing cover.
Figure 10B:
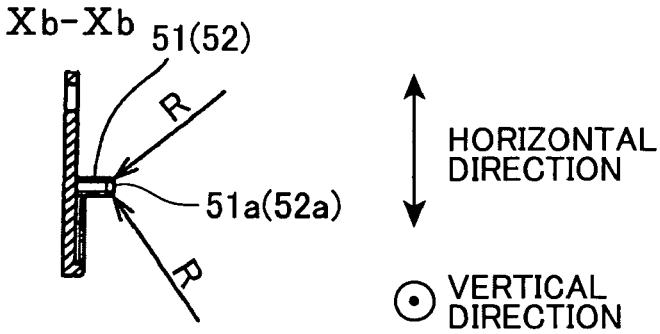

FIG. 10(*a*) shows the protrusion-shaped contact member 51 (52) provided to the casing cover base 111*d*. It is noted that only a rear end part of the casing cover base 111*d* is shown in FIG. 10(*a*) for clarity. FIG. 10(*b*) shows a cross-section of the protrusion-shaped contact member 51 (52) taken along a line Xb-Xb in FIG. 10(*a*). The right and left side edges on the rear end surfaces 51*a*, 52*a* of the protrusion-shaped contact members 51 and 52 are rounded, as shown in FIG. 10(*b*).

Next will be described how the main casing cover 111 operates to mount the process cartridge 18 to the image-forming position with reference to FIGS. 8(*a*)-8(*c*) and FIGS. 9(*a*)-9(*c*).

As shown in FIGS. 8(*a*), 8(*b*), and 8(*c*), the main casing cover 111 is rotated clockwise around the support shaft 57 until the engaging hook 53 provided to the inner side of the upper portion 111*b* in the main casing cover ill engages with the engaging pawl 55 mounted on the main casing 2. At this time, the end portion 53*a* of the engaging hook 53 contacts an end portion 55*a* of the engaging pawl 55, as shown in FIG. 8(*b*). Further, the protrusion-shaped contact member 51 mounted on the casing cover base 111*d* contacts the resilient tongue-shaped contact member 18*c* provided on the process cartridge 18, and the protrusion-shaped contact member 52 mounted on the casing cover base 111*d* contacts the resilient tongue-shaped contact member 18*d* provided on the process cartridge 18, as shown in FIG. 8(*c*).

When the main casing cover 111 is pushed farther rearward (R direction in FIG. 8(*a*)) from this position, the protrusion-shaped contact members 51 and 52 push the resilient tongue-shaped contact members 18*c* and 18*d* rearward (R direction in FIG. 8(*a*)). Since the protrusion-shaped contact members 51 and 52 contact the resilient tongue-shaped contact members 18*c* and 18*d*, the casing cover base 111*d* contacts the process cartridge 18 at two positions, applying a force parallel to the direction in which the process cartridge 18 is inserted and preventing the generation of torque that attempts to rotate the process cartridge 18 within a plane parallel to the plane of the insertion direction. As a result, the process cartridge 18 can be mounted in the image-forming position in a stable state.

As described above, the resilient tongue-shaped contact members 18*c* and 18*d* are provided on the lower end of the front surface of the process cartridge 18. Accordingly, the protrusion-shaped contact members 51 and 52 are disposed at positions capable of opposing the resilient tongue-shaped contact members 18*c* and 18*d* when the main casing cover 111 is rotated about the support shaft 57 provided on the main casing 2, with a minimum distance between the protrusion-shaped contact members 51 and 52 and the support shaft 57. This construction reduces the amount that the protrusion-shaped contact members 51 and 52 move in the rotational direction, as the main casing cover 111 rotates. As a result, it is possible to reduce the amount of resilient displacement in the resilient tongue-shaped contact members 18*c* and 18*d* that are pressed by the protrusion-shaped contact members 51 and 52, thereby improving the durability of the resilient tongue-shaped contact members 18*c* and 18*d*.

As shown in FIG. 8(*c*), only a portion of the contact surfaces (vertical surfaces) 51*a*, 52*a* of the protrusion-shaped contact members 51 and 52 contact the resilient tongue-shaped contact members 18*c* and 18*d* at this time. Accordingly, the durability of the protrusion-shaped contact members 51 and 52 can be improved. Further, the contact surfaces 51*a* and 52*a* of the protrusion-shaped contact members 51 and 52 contact the contact surfaces 180*c* and 180*d* of the resilient tongue-shaped contact members 18*c* and 18*d* in such a state that the contact surfaces 51*a* and 52*a* are in parallel with the contact surfaces 180*c* and 180*d*. It is ensured that the surfaces of the protrusion-shaped contact members 51 and 52 contact the surfaces of the resilient tongue-shaped contact members 18*c* and 18*d*, avoiding a concentration of stress on any contact portion. Deformation of or damage to the protrusion-shaped contact members 51 and 52 and the resilient tongue-shaped contact members 18*c* and 18*d* can be avoided.

In addition, the right and left edges on the rear ends of the protrusion-shaped contact members 51 and 52 are rounded as shown in FIG. 10(*b*) so that there are no sharp edges, thereby avoiding point or line contacts between the protrusion-shaped contact members 51 and 52 and the resilient tongue-shaped contact members 18*c* and 18*d*. As a result, deformation of or damage to the protrusion-shaped contact members 51 and 52 or the resilient tongue-shaped contact members 18*c* and 18*d* can be prevented, improving the durability of the same.

FIG. 9(*a*) shows the positional relationship between the main casing cover 111 and the process cartridge 18 when the process cartridge 18 is completely mounted in the image-forming position by the main casing cover 111. FIG. 9(*b*) is a detailed view of a portion IXb in FIG. 9(*a*), and FIG. 9(*c*) is a detailed view of a portion IXc in FIG. 9(*a*).

When the process cartridge 18 is completely mounted in the image-forming position, as shown in FIG. 9(*a*) and FIG. 9(*b*), the end portion 55*a* of the engaging pawl 55 slides over the end portion 53*a* of the engaging hook 53 until achieving a state of engagement with the engaging recess 53*b*. At this time, the main casing cover 111 moves forward (F direction in FIG. 9(*b*)) by the distance of overlap when the end portion 53*a* of the engaging hook 53 engages with the end portion 55*a* of the engaging pawl 55. Accordingly, a gap d is formed between the protrusion-shaped contact member 51 and the resilient tongue-shaped contact member 18*c*, as shown in FIG. 9(*c*). This gap d is also formed between the protrusion-shaped contact member 52 and the resilient tongue-shaped contact member 18*d*. Hence, the protrusion-shaped contact members 51 and 52 become separated from the resilient tongue-shaped contact members 18*c* and 18*d*. With this construction, vibrations and the like generated in the main casing 2 are not transferred to the process cartridge 18, thereby helping to maintain the process cartridge 18 in a fixed alignment.

As described above, in order to mount the process cartridge 18 in the image-forming position in the main casing 2, the process cartridge 18 is inserted through the opening 2*a* formed on the front surface of the main casing 2, guided along the guiding grooves 2*e* and 2*f*. The process cartridge 18 is then pushed into position by the main casing cover 111 when the main casing cover 111 is closed. At this time the protrusion-shaped contact members 51 and 52 mounted on the main casing cover 111 push the resilient tongue-shaped contact members 18*c* and 18*d* mounted on the process cartridge 18 in the mounting direction, and the process cartridge 18 is guided by the terminal guiding grooves 2*g*, 2*j* to be completely mounted in the image-forming position. Resiliency of the contact members 18*c* and 18*d* is employed for pushing the process cartridge 18 into the image-forming position and no spring is employed for guiding the process cartridge 18 into the image-forming position. Accordingly, the process cartridge 18 need not be pressed by a force strong enough to resist the urging force of a spring when pushed into the image-forming position. Accordingly, the process cartridge 18 can be easily pushed into the image-forming position.

Further, when removing the process cartridge 18 mounted in the image-forming position from the main casing 2, an Open Cover button 2*p* (see FIG. 2) is pressed, causing the engaging hook 53 to rotate upward around a shaft (not shown) and disengage from the engaging pawl 55. Accordingly, the main casing cover 111 opens, allowing the process cartridge 18 to be removed. Since no spring is provided for urging the process cartridge 18 in the mounting direction, the protruding portions 18*a*, 11*a*, 18*b* that protrude from both sides of the process cartridge 18 do not incur any resistance when moved along the guiding grooves 2*e* and 2*f* in a direction opposite the mounting direction. Hence, the process cartridge 18 can be smoothly removed from the main casing 2.

In the above description, the protrusion-shaped contact members 51, 52 are provided on the main casing cover 111, and the resilient tongue-shaped contact members 18*c* and 18*d* are provided on the process cartridge 18. However, the protrusion-shaped contact members 51, 52 may be provided on the process cartridge 18, while the resilient tongue-shaped contact members 18*c* and 18*d* be provided on the main casing cover 111.

Figure 11A:
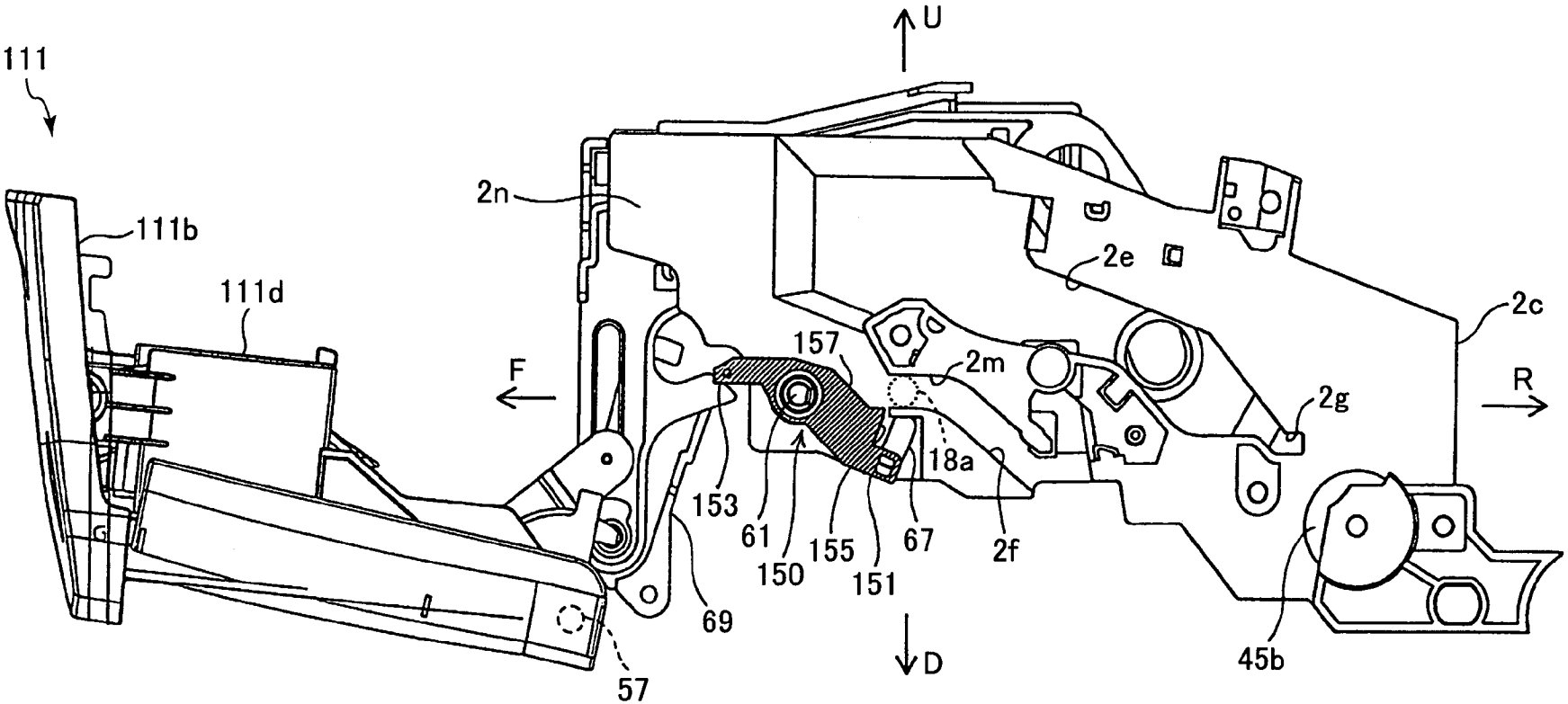
FIG. 11(*a*) is a side view showing the left side panel and the main casing cover in an open state.
Figure 11B:
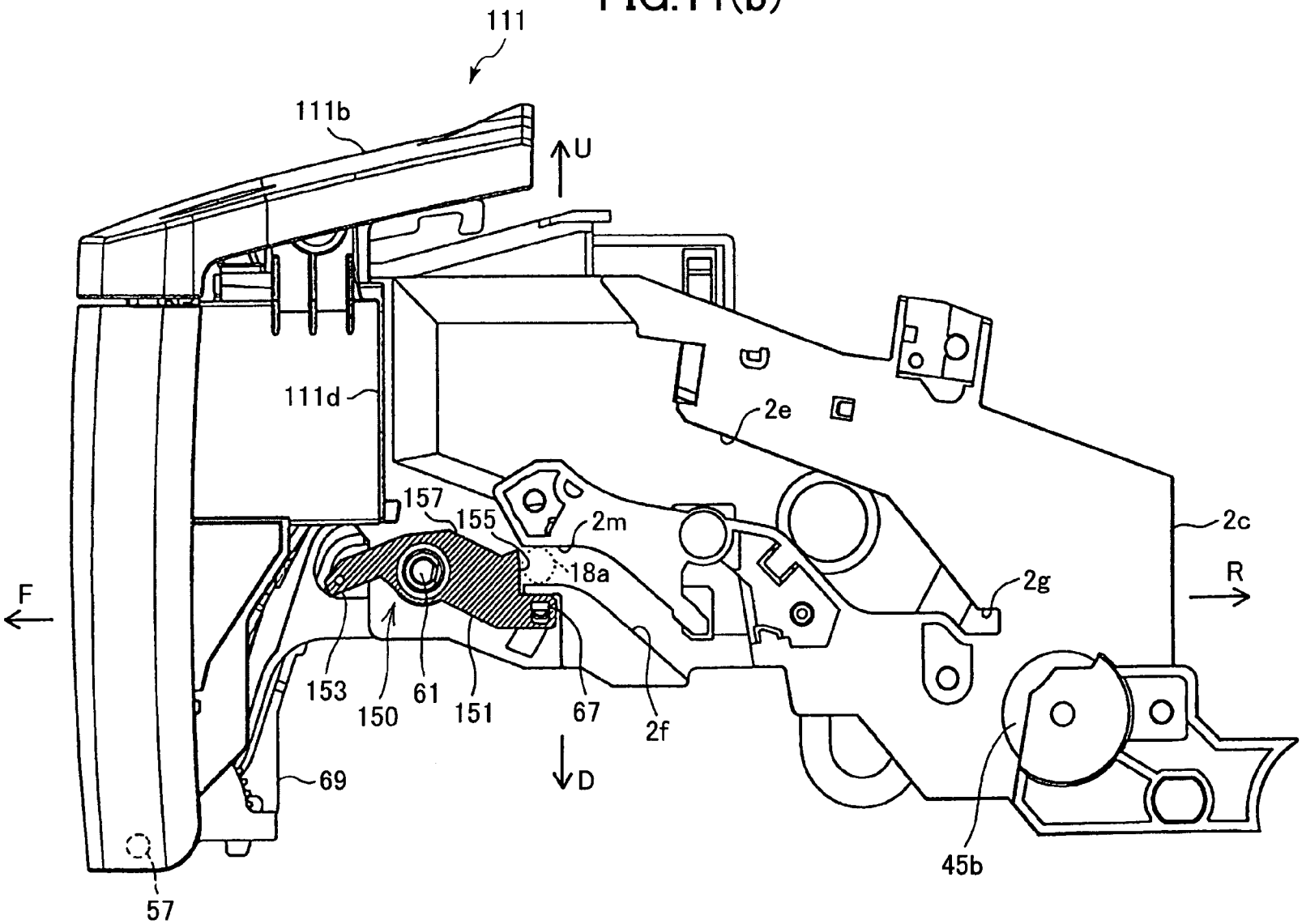

FIG. 11(*a*) shows the positional relationship between the main casing cover 111 and the left-side panel 2*c* when the main casing cover 111 is in an open state.

As indicated by hatch lines in FIG. 11(*a*), a lever 150 is disposed on the front end (toward the F direction in FIG. 11(*a*)) of the lower guiding groove 2*f* on the left side casing 2*c*. It is noted that showing of the lever 150 is eliminated from FIGS. 6-7(*c*) for clarity.

The lever 150 is a flat plate-shaped member having a predetermined thickness in the left-to-right direction of the laser printer 1 and a long slender shape in the front-to-back direction (the F or R direction in FIG. 11(*a*)) with a shape that substantially follows the shape of the lower guiding groove 2*f*. A shaft 61 supports the lever 150 near the center portion thereof, enabling the lever 150 to pivot around the shaft 61. One end of the shaft 61 is attached to the side panel 2*c*, while the other end is attached to the side panel 2*d* described later on the side opposing the side panel 2*c*.

A rear end 151 of the lever 150 positioned behind the shaft 61 (toward the R direction of FIG. 11(*a*)) is connected to a spring 67. The spring 67 urges the rear end 151 upward (in the U direction of FIG. 11(*a*)) toward the lower guiding groove 2*f*. A protruding part 155 is formed near the rear end 151. The protruding part 155 can switch between a restricting position to restrict the process cartridge 18 from moving out of the image-forming position in the opposite direction of the mounting direction, and a non-restricting position not to restrict movement of the process cartridge 18. More specifically, the protruding part 155 is formed of a size large enough to protrude upward into the lower guiding groove 2*f* from the bottom thereof when the rear end 151 of the lever 150 is pivoted upward (U direction) around the shaft 61, in order to block the lower guiding groove 2*f* vertically (the U or D direction in FIG. 11(*a*)). FIG. 11(*a*) shows the non-restricting position in which the protruding part 155 does not protrude upward into the lower guiding groove 2*f*.

A front end 153 of the lever 150 on the front side of the shaft 61 (toward the F direction in FIG. 11(*a*)) is connected to one end of a link 69. The other end of the link 69 is connected to the main casing cover 111. Therefore, the lever 150 can pivot around the shaft 61 within a plane parallel to the mounting direction of the process cartridge 18.

When the main casing cover 111 is opened as shown in FIG. 11(*a*), the front end 153 of the lever 150 connected to one end of the link 69 is pushed upward in association with the movement of the link 69. As a result, the rear end 151 of the lever 150 is pushed downward around the shaft 61, opposing the urging force of the spring 67. Accordingly, a top surface 157 of the lever 150 becomes flush with the bottom surface of the lower guiding groove 2*f*, forming an extension of the lower guiding groove 2*f* on the front side (F direction in FIG. 11(*a*)) thereof. Therefore, the lever 150 becomes an extension of the lower guiding groove 2*f* for guiding the pinch roller shaft 11*a* and the fixing boss 18*a*, thereby facilitating a stable operation for mounting the process cartridge 18 in or removing the process cartridge 18 from the main casing 2.

FIG. 11(*b*) shows the positional relationship between the main casing cover 111 and the left-side panel 2*c* when the main casing cover 111 is in a closed state, that is, when the main casing cover 111 is rotated upward from the open state shown in FIG. 11(*a*) and completely closed.

As shown in FIG. 11(*b*), when the main casing cover 111 is rotated upward around the rotational center (support shaft) 57 and closed, the lever 150 pivots counterclockwise around the shaft 61 in association with the movement of the link 69 connected to the main casing cover 111. As a result, the front end 153 of the lever 150 pivots downward (D direction in FIG. 11(*b*)) around the shaft 61, while the rear end 151 of the lever 150 simultaneously pivots upward (U direction in FIG. 11(*b*)) around the shaft 61. At this time, the protruding part 155 provided on the rear end 151 of the lever 150 protrudes upward into the lower guiding groove 2*f*, blocking the lower guiding groove 2*f* vertically. FIG. 11(*b*) shows the restricting position in which the protruding part 155 protrudes upward into the lower guiding groove 2*f* and blocks the groove vertically (U or D direction in FIG. 11(*b*)). The lever 150 may be formed of a synthetic resin, metal, or the like.

Figure 12:
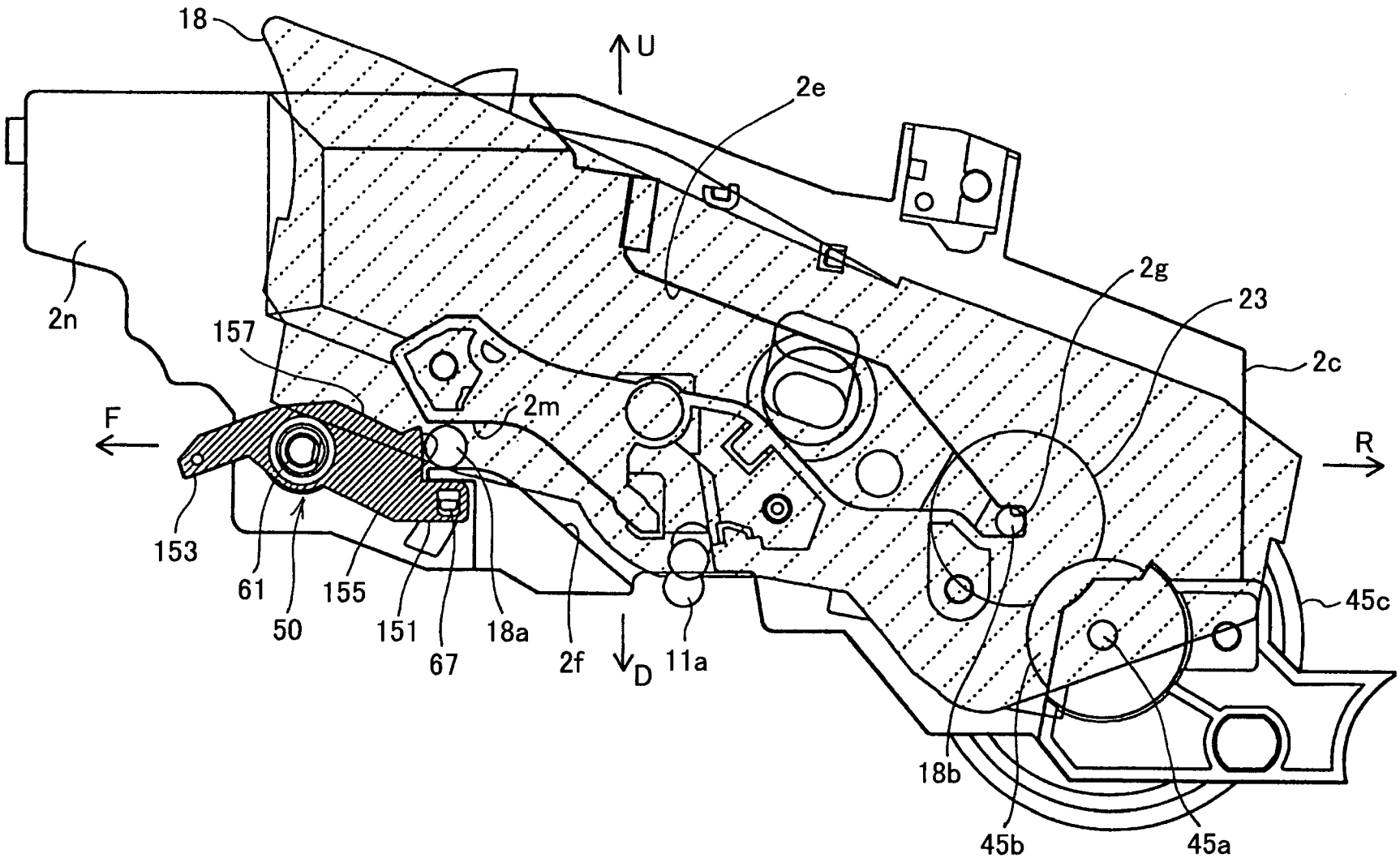
FIG. 12 is a side view showing the process cartridge mounted in the image-forming position.

FIG. 12 shows the positional relationship between the lever 150 and the process cartridge 18 mounted in the image-forming position. The process cartridge 18 is indicated by dotted hatch lines in FIG. 12. The photosensitive drum shaft 18*b* of the photosensitive drum 23 provided on the process cartridge 18 is guided toward the rear (R direction in FIG. 12) along the upper guiding groove 2*e* formed on the side panel 2*c* until reaching the end of the terminal guiding groove 2*g* that extends horizontally at the end of the upper guiding groove 2*e*. The pinch roller shaft 11*a* and the fixing boss 18*a* provided on the process cartridge 18 are simultaneously guided along the lower guiding groove 2*f* toward the rear. In this way, the process cartridge 18 can be stably guided along the upper guiding groove 2*e* and the lower guiding groove 2*f* and mounted in the image-forming position.

Figure 13:
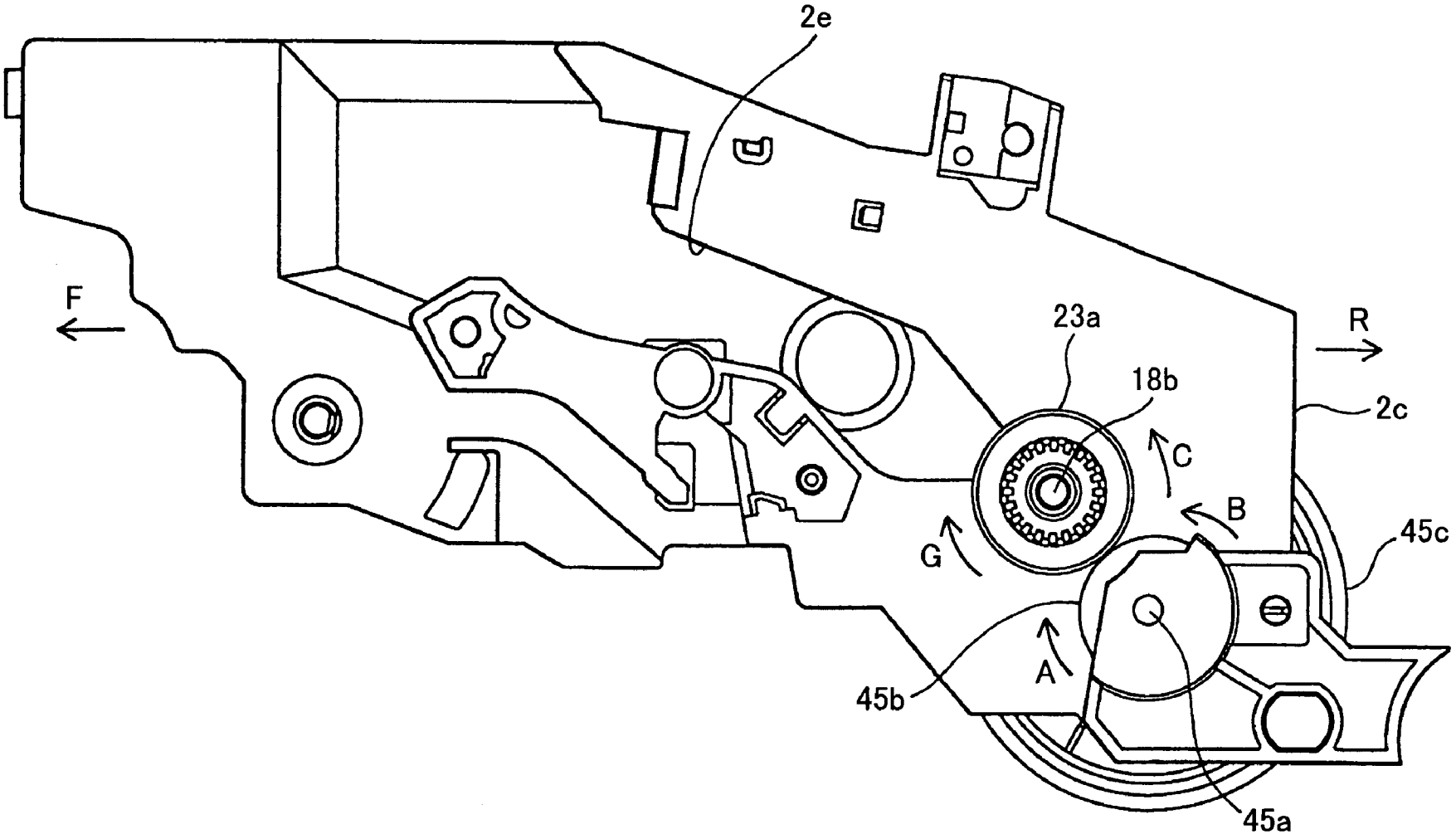
FIG. 13 is a side view showing a cartridge gear of a photosensitive drum engaged with a drive gear.

As shown in FIG. 13, a cartridge gear 23*a* is provided on the process cartridge 18. The cartridge gear 23*a* is coupled with the photosensitive drum 23. In other words, both the cartridge gear 23*a* and the photosensitive drum 23 are rotatably attached over the photosensitive drum shaft 18*b* in such a manner that the cartridge gear 23*a* and the photosensitive drum 23 are rotable together around the photosensitive drum shaft 18*b*. The cartridge gear 23*a* is provided on one end of the photosensitive drum shaft 18*b* at a position outside the process cartridge 18 and facing the left side panel 2*c*. A drive gear 45*b* is provided in the main casing 2 on the left side panel 2*c*. When the process cartridge 18 is mounted in the image-forming position, the cartridge gear 23*a* engages with the drive gear 45*b*, which transfers a driving force to the cartridge gear 23*a*.

When the process cartridge 18 is mounted in the image-forming position and the main casing cover 111 of the main casing 2 is closed, as shown in FIG. 11(*b*), the lever 150 pivots in association with the closing movement of the main casing cover 111. The protruding part 155 provided on the rear end 151 is thrust upward into the lower guiding groove 2*f*, as shown in FIG. 11(*b*). As shown in FIG. 12, the protruding part 155 engages with the fixing boss 18*a*, which is the forwardmost of the three protruding parts 18*a*, 11*a*, 18*b* projecting from the left and right sides of the process cartridge 18.

Since the lever 150 is disposed adjacent to the guiding groove 2*f* of the side panel 2*c* on the left side of the main casing 2, the protruding part 155 engages with the portion of the fixing boss 18*a* protruding from the left side of the process cartridge 18. Further, since the lever 150 is disposed adjacent to the lower guiding groove 2*f* provided on the side panel 2*c*, which is nearer to the drive gear 45*b* than the side panel 2*d*, the protruding part 155 and the fixing boss 18*a* engage with each other within the lower guiding groove 2*f* at a position near the drive gear 45*b*. By the engagement of the drive gear 45*b* and the cartridge gear 23*a*, which is provided coaxially with the photosensitive drum 23, the process cartridge 18 receives a force restricting the process cartridge 18 from moving out of the image-forming position in a direction opposite the mounting direction at a location near the drive gear 45*b*. Accordingly, it is possible to reduce the torque generated by this force that attempts to rotate the process cartridge 18 in a plane parallel to the mounting direction. It is possible to effectively prevent the process cartridge 18 from rotating in the plane parallel to the mounting direction. The cartridge gear 23*a* and the drive gear 45*b* are each configured of a helical gear.

Next, operations will be described for switching between the restricting position in which the process cartridge 18 is restricted from moving out of the image-forming position in a direction opposite the mounting direction, and a non-restricting position in which the restrictions on movement are cancelled.

FIG. 13 shows the state of engagement between the cartridge gear 23*a* of the photosensitive drum 23 and the drive gear 45*b* when the process cartridge 18 is mounted in the image-forming position. FIG. 13 focuses only on the cartridge gear 23*a* mounted on the process cartridge 18 and shows the state of the cartridge gear 23*a* engaged with the drive gear 45*b* provided on the main casing 2. The drive gear 45*b* is integrally formed with a large-diameter gear 45*c*. The gears 45*b* and 45*c* are mounted so as to be capable of rotating in forward and reverse directions around a drive gear shaft 45*a*. The drive gear shaft 45*a* is supported on the left side panel 2*c*. A driving force is transferred to the large-diameter gear 45*c* from a drive motor (not shown).

During an image-forming process, the drive gear 45*b* rotates clockwise (the A direction in FIG. 13) about the drive gear shaft 45*a*. At this time, the cartridge gear 23*a* engaged with the drive gear 45*b* rotates counterclockwise (the C direction in FIG. 13). Hence, a force pushing the photosensitive drum 23 toward the drive gear 45*b* acts on the cartridge gear 23*a* of the photosensitive drum 23.

When a paper jam or the like occurs or when a maintenance operation is executed, it is necessary to stop applying a forward driving force to the photosensitive drum 23 and to rotate the photosensitive drum 23 in a backward direction by some fixed amount. Accordingly, the drive gear 45*b* has to be rotated in a direction opposite the direction of rotation during image formation. When the drive gear 45*b* is rotated in the direction opposite that used during image formation (the B direction in FIG. 13), the cartridge gear 23*a* rotates in the G direction in FIG. 13. At this time, a force acts on the photosensitive drum 23, attempting to push the photosensitive drum 23 forward (the F direction in FIG. 13). Accordingly, a force acts on the process cartridge 18, on which the photosensitive drum 23 is mounted, attempting to move the process cartridge le out of the image-forming position in the forward direction (the F direction in FIG. 13), which is opposite the mounting direction.

However, since the process cartridge 18 is mounted in the image-forming position at this time, the main casing cover 111 of the main casing 2 is closed, as shown in FIG. 11(*b*). Accordingly, the protruding part 155 on the lever 150 protrudes into the lower guiding groove 2*f* from the bottom thereof, blocking the lower guiding groove 2*f* in the vertical direction, and the fixing boss 18*a* provided on the process cartridge 18 is engaged with the protruding part 155. Thus, the lever 150 is in the restricting position for restricting the process cartridge 18 from moving out of the image-forming position in a direction (F direction in FIG. 13) opposite the mounting direction.

With this construction, movement of the process cartridge 18 out of the image-forming position in the direction opposite the mounting direction is restricted by the engagement of the fixing boss 18*a* and the protruding part 155, even when a paper jam or the like occurs and the drive gear 45*b* is rotated in the reverse direction from the direction used during image formation. Since the drive gear 45*b* and the cartridge gear 23*a* are never disengaged, there is no fear of noise or damage caused by gear teeth slipping when the drive gear 45*b* and cartridge gear 23*a* are engaged.

When the main casing cover 111 is opened, as shown in FIG. 11(*a*), the rear end 151 of the lever 150 is pressed downward in association with the movement of the main casing cover 111, overcoming the urging force of the spring 67. At this time, the protruding part 155 is withdrawn from the lower guiding groove 2*f* into the non-restricting position. Accordingly, the process cartridge 18 can be inserted through the opening 2*a* formed in the front portion of the main casing 2 and guided along the upper guiding groove 2*e* and lower guiding groove 2*f* in one motion in the mounting direction until mounted in the image-forming position. Moreover, the lever 150 is configured to form a portion of the lower guiding groove 2*f* for guiding the pinch roller shaft 11*a* and the fixing boss 18*a*, thereby facilitating stable mounting and removal of the process cartridge 18 with respect to the main casing 2.

As described above, the laser printer 1 shown in FIG. 1 supplies toner from the toner hopper 26 to the developing roller 27 to develop an electrostatic latent image formed on the surface of the photosensitive drum 23 into a visible image that is subsequently transferred onto the paper 3. After the paper 3 separates from the photosensitive drum 23 and is conveyed to the fixing unit 19, the photosensitive drum 23 is still driven to rotate by the main motor. Hence, the developing roller 27 that is engaged with the photosensitive drum 23 also continues to rotate. However, allowing the developing roller 27 to rotate when toner remains thereon may accelerate the deterioration or change in quality of that toner. It is unnecessary to keep the developing roller 27 engaged with the photosensitive drum 23 after the paper 3 has separated from the photosensitive drum 23. A pair of separating cams 83 are therefore provided to the shaft 61 and controlled to rotate about the shaft 61 to separate the developing roller 27 from the photosensitive drum 23, as shown in FIG. 14(*a*) through FIG. 14(*c*).

Figure 14A:
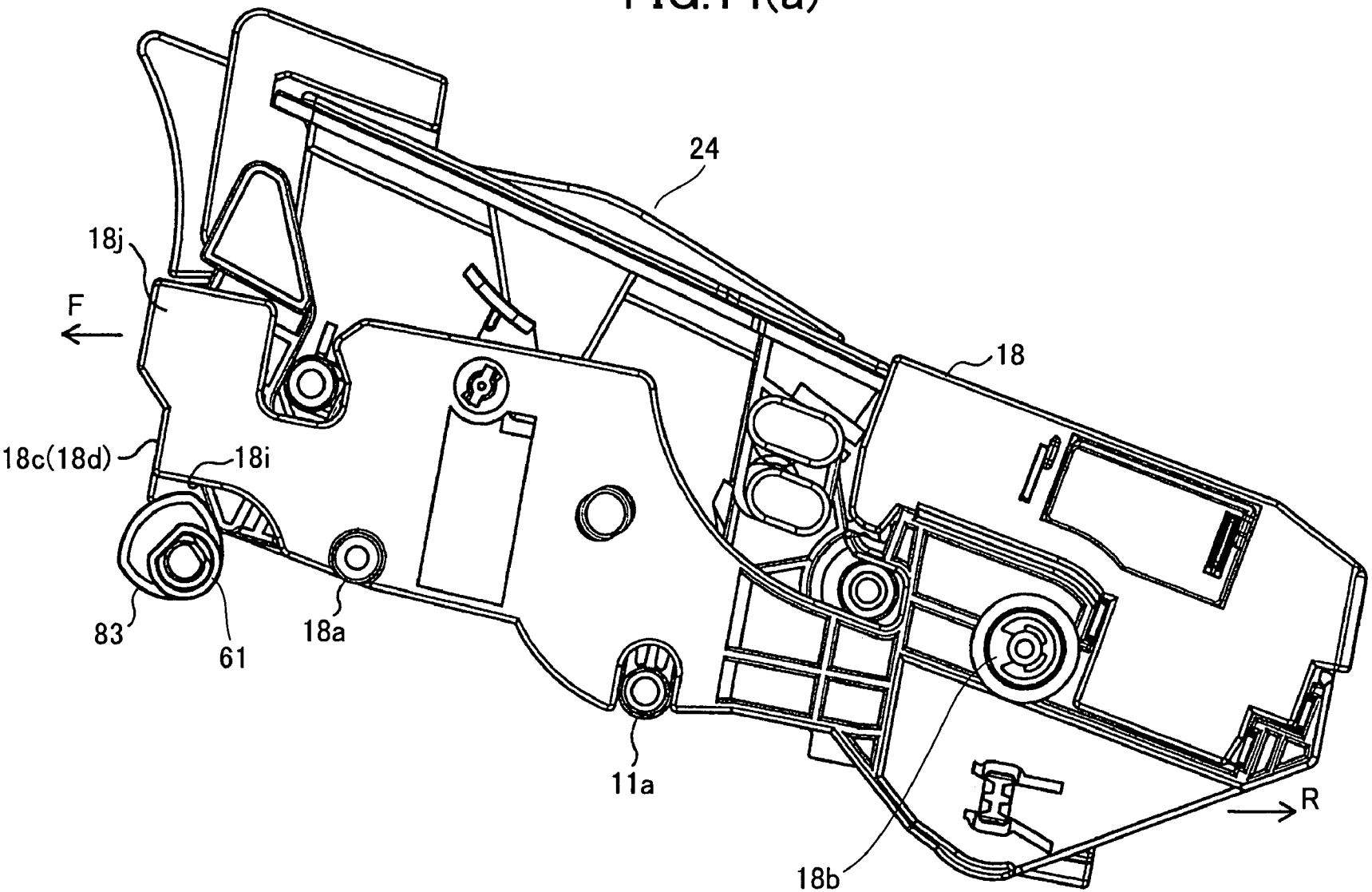
FIG. 14(*a*), FIG. 14(*b*), and FIG. 14(*c*) are side views illustrating the operations of a separating cam, wherein FIG. 14(*a*) shows the positional relationship between the separating cam and the process cartridge, FIG. 14(*b*) shows the positional relationship between the separating cam and a part of the process cartridge that is surrounded by an outer panel of the process cartridge, and FIG. 14(*c*) shows the positional relationship between the separating cam and the developing cartridge in the process cartridge.
Figure 14B:
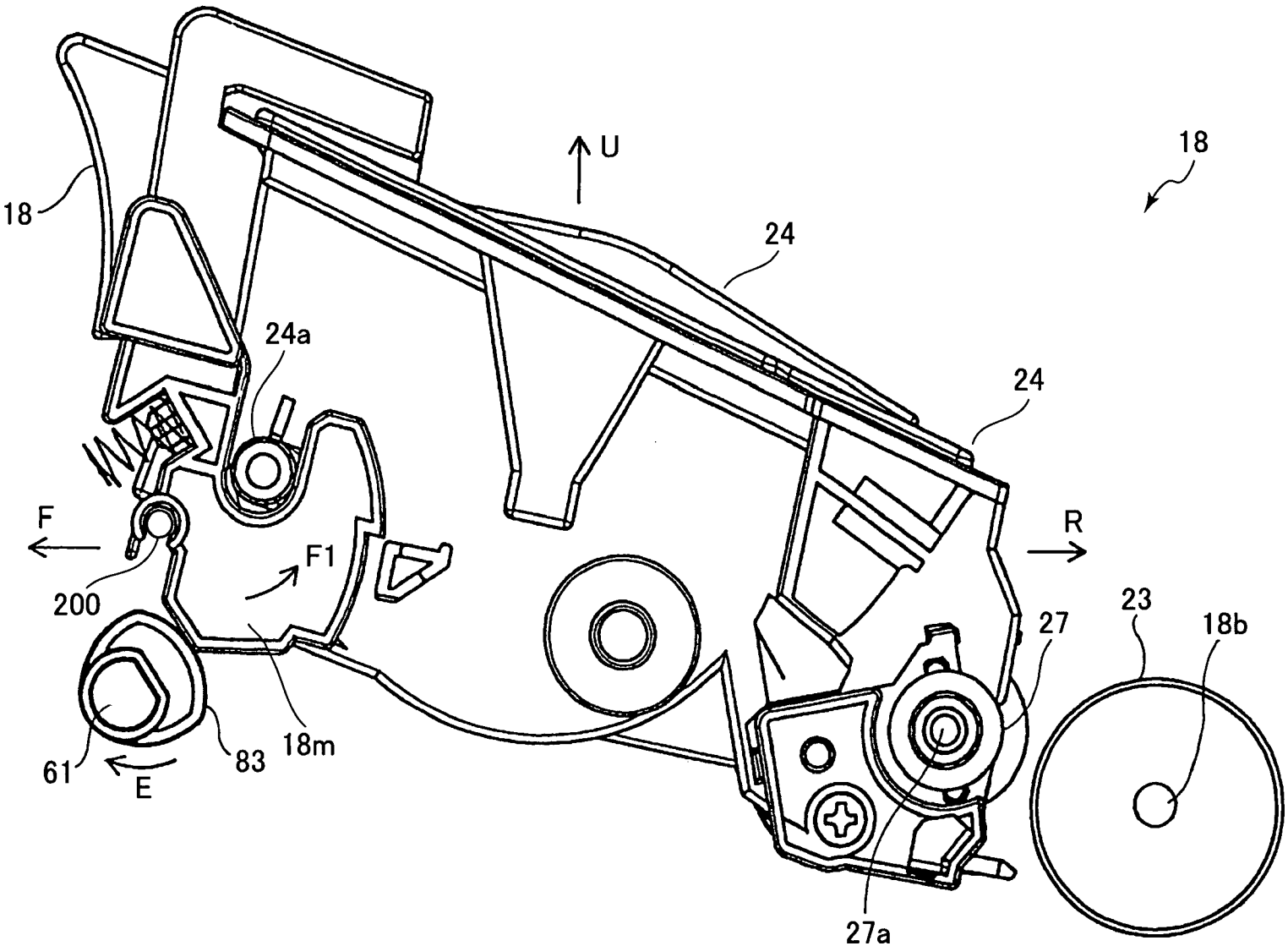
Figure 14C:
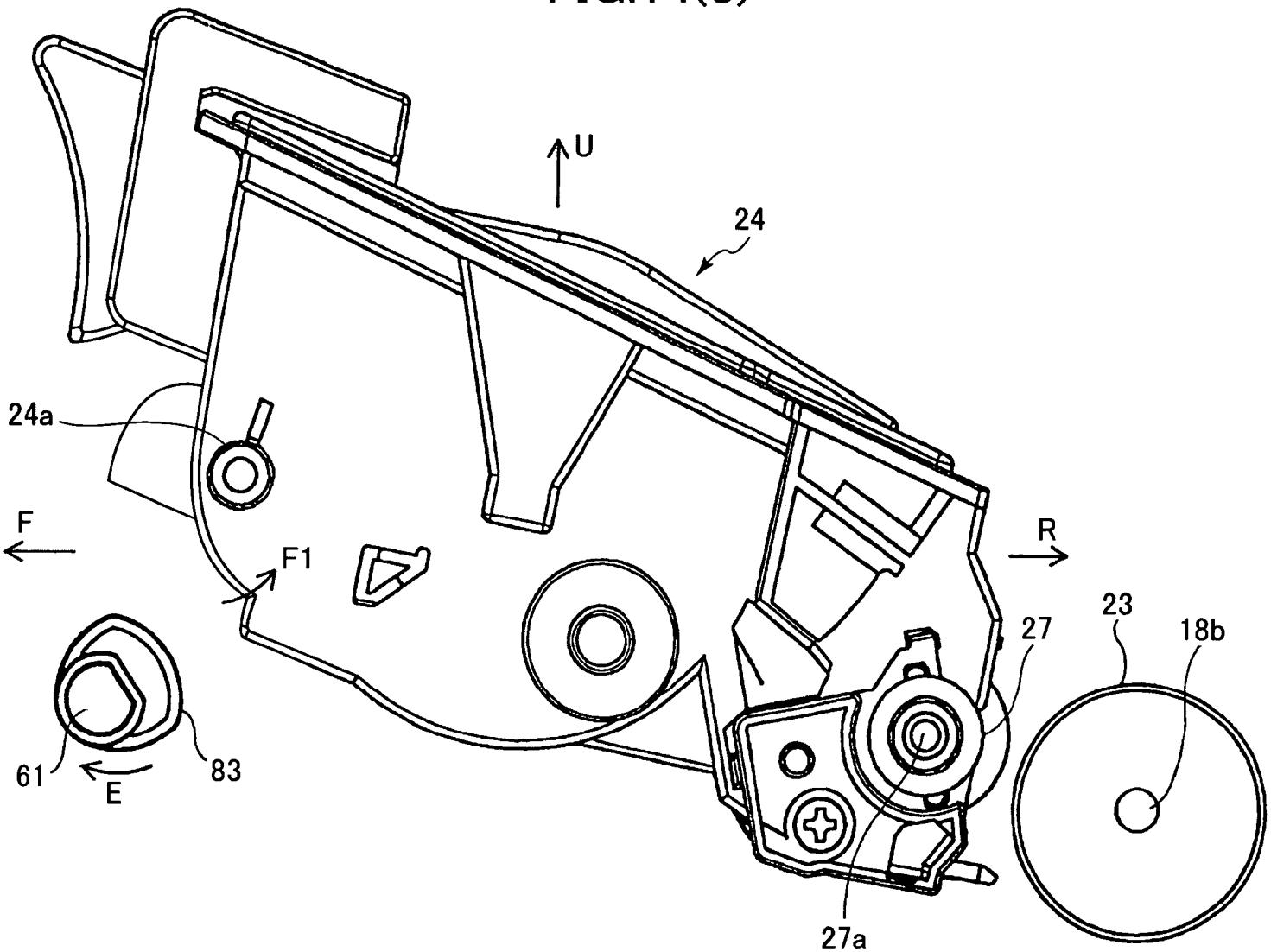

FIG. 14(*a*) shows the positional relationship between the separating cam 83 and the entire process cartridge 18. FIG. 14(*b*) shows the positional relationship between the separating cam 83 and a part of the process cartridge 18 that is surrounded by the outer panel 18*j* of the process cartridge 18. In other words, FIG. 14(*b*) shows the positional relationship between the separating cam 83 and the process cartridge 18, from which the outer panel 18*j* is removed. FIG. 14(*c*) shows the positional relationship between the separating cam 83 and the developing cartridge 24 in the process cartridge 18.

The pair of separating cams 63, one of which is shown in each of FIG. 14(*a*), FIG. 14(*b*), and FIG. 14(*c*), are provided in the main casing 2. The separating cams 83 are fixedly mounted near both side ends of the shaft 61. The shaft 61 is driven by a special motor (not shown). Each separating cam 83 is a plate-shaped cam having a predetermined thickness and a circular cross-section. The separating cams 83 face the front end (facing the F direction of FIG. 14(*a*)) of the process cartridge 18 when the process cartridge 18 is mounted in the image-forming position within the main casing 2.

As apparent from FIG. 14(*a*) and FIG. 14(*b*), the photosensitive drum shaft 18*b* is supported on the outer panel 18*j* and extends in the left-and-right direction that is orthogonal to the mounting or removing direction (R or F direction in FIG. 14(*a*)) of the process cartridge 18. The photosensitive drum 23 is supported on the photosensitive drum shaft 18*b*. The process cartridge 18 has a pair of U-shaped pieces 18*m* on both right and left sides thereof. One of the U-shaped pieces 18*m*, which is located on the right side of the process cartridge 18, is shown in FIG. 14(*b*). The U-shaped pieces 18*m* are surrounded by the outer panel 18*j* as apparent from FIG. 14(*a*) and FIG. 14(*b*). As shown in FIG. 14(*b*), each U-shaped piece 18*m* is rotatably supported on a shaft 200, which is supported on the outer panel 18*j* and which extends in the left-and-right direction orthogonal to the mounting or removing direction (R or F direction in FIG. 14(*a*)) of the process cartridge 18. Each U-shaped piece 18*m* is engageable with the separating cam 83. As shown in FIG. 14(*b*) and FIG. 14(*c*), the developing cartridge 24 has a pair of protrusions 24*a*, which protrude from left and right sides of the developing cartridge 24 in the left-and-right direction orthogonal to the mounting or removing direction (R or F direction in FIG. 14(*a*)) of the process cartridge 18. Each protrusion 24*a* is received on a corresponding U-shaped piece 18*m*. When the separating cam 83 engages with the U-shaped piece 18*m* and rotates in the direction E, the U-shaped piece 18*m* rotates in the direction F1, thereby generating a force attempting to change the positional relationship between the developing cartridge 24 and the photosensitive drum 23.

Specifically, when the separating cam 83 is rotated clockwise (E direction in FIG. 14(*b*)), the top surface of the separating cam 83 contacts the bottom surface of the U-shaped piece 18*m*, rotating the U-shaped piece 18*m* in the direction F1, thereby generating a force to rotate the process cartridge 18 as a whole about a prescribed axis. The force is applied to the process cartridge 18 to move the front end of the process cartridge 18, including the developing cartridge 24, upward (F1 direction in FIG. 14(*b*)). If the front end of the process cartridge 18 and the developing cartridge 24 moved upward, however, it will become difficult to separate the developing roller 27 from the photosensitive drum 23.

As shown in FIG. 12, the lower guiding groove 2*f* is formed such that a top surface 2*m* of the lower guiding groove 2*f* engages with the fixing boss 18*a* protruding from both sides of the process cartridge 18, thereby restricting the process cartridge 18 from rising. Accordingly, the developing roller 27 can properly be moved forward (F direction in FIG. 14(*b*)) from the photosensitive drum 23 and reliably separated from the photosensitive drum 23. In so doing, the driving force transferred from the photosensitive drum 23 for rotating the developing roller 27 is interrupted. By halting rotations of the developing roller 27 in this way, it is possible to delay deteriorations or changes in quality of toner accommodated in the toner hopper 26 that is caused by such rotations.

As shown in FIG. 14(*a*), a space 18*i* is formed within the outer panel 18*j* for receiving the separating cams 83 therein and for allowing the separating cams 83 to engage with the U-shaped pieces 18*m*. The separating cams 83 functions to separate the developer cartridge 24 from the front side of the photosensitive drum 23. The space 18*i* is formed to penetrate the process cartridge 18 vertically. Since the resilient tongue-shaped contact members 18*c* and 18*d* are formed in the outer panel 18*j*, the space 18*i* also serves as a space for allowing the displacement of the resilient tongue-shaped contact members 18*c* and 18*d*, thereby facilitating construction of the mold for producing the process cartridge 18.

Figure 15:
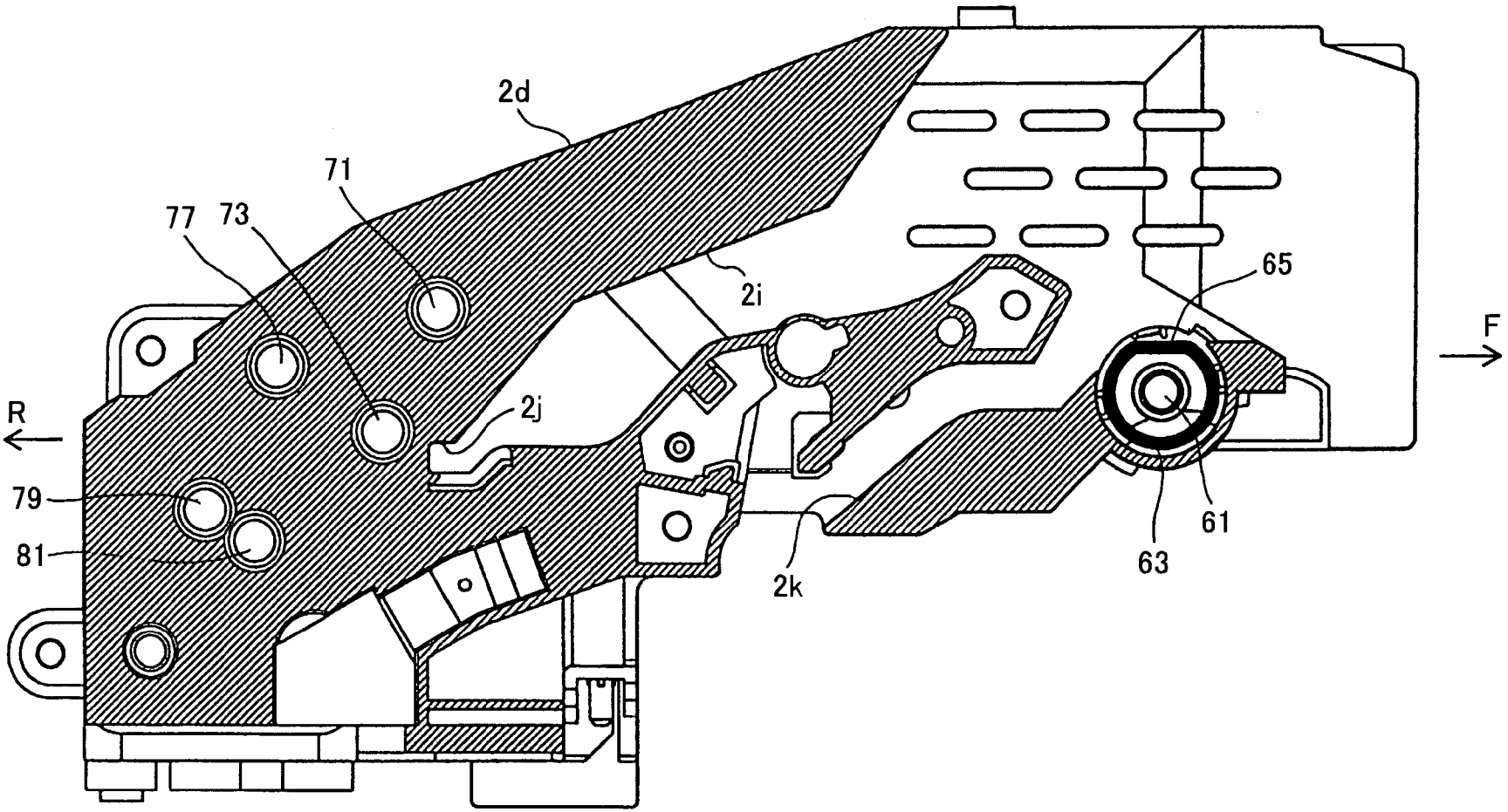
FIG. 15 is a side view showing the shape of guiding grooves formed on an inner side of a right side panel of the main casing.

FIG. 15 shows the construction of the side panel 2*d* on the right side of the main casing 2 opposite the side panel 2*c*.

As shown in FIG. 15, the side panel 2*d* is provided with: an upper guiding groove 2*i* having the same formation as the upper guiding groove 2*e* provided on the side panel 2*c*; and a lower guiding groove 2*k* having the same shape as the lower guiding groove 2*f* provided on the side panel 2*c*. A terminal guiding groove 2*j* extending horizontally and having the same shape as the terminal guiding groove 29 provided in the side panel 2*c* is formed at the end of the upper guiding groove 2*i* in the rear direction (R direction in FIG. 15). When the process cartridge 18 is mounted in the main casing 2, the photosensitive drum shaft 18*b* provided on the process cartridge 18 is guided along the upper guiding groove 2*i*, while the pinch roller shaft 11*a* and the fixing boss 18*a* are guided along the lower guiding groove 2*k*.

An end of the shaft 61 opposite from the end, at which the lever 150 is mounted, is rotatably supported on the right side panel 2*d* via a bearing 63. The bearing 63 is fixedly mounted on the inner side of the right side panel 2*d*. A top surface 65 of the bearing 63 is formed in a flat shape and is used as part of the lower guiding groove 2*k*. Accordingly, the lower guiding groove 2*k* extends farther toward the front of the main casing 2 (F direction in FIG. 15) by the portion of the top surface 65 of the bearing 63 that forms part of the bottom surface of the lower guiding groove 2*k*, thereby facilitating the stable mounting and removal of the process cartridge 18 with respect to the main casing 2.

In the preferred embodiment described above, the lever 150 pivots about the shaft 61 in association with the opening and closing operations of the main casing cover 111. However, a manual lever may be provided as a variation of the preferred embodiment so that the lever 150 is pivoted about the shaft 61 through operations of the manual lever.

As shown in FIG. 15, the side panel 2*d* is provided with electrodes 71, 73, 77, 79, and 81 that have spherical ends and are capable of protruding from or receding into the side panel 2*d*. When the process cartridge 18 is mounted in the image-forming position, the electrodes 71, 73, 77, 79, and 81 on the side panel 2*d* side connect to electrodes provided on the process cartridge 18 side, enabling the conductance of electricity between the main casing 2 and the process cartridge 18.

As described above, according to the present embodiment, the laser printer 1 includes: the main casing 2 with two side walls 2*c* and 2*d*; the lower guiding grooves 2*f* and 2*k* formed in the side walls 2*c* and 2*d*, respectively; the process cartridge 18 that is guided by the guiding grooves 2*f* and 2*k* to be mounted in or removed from the main casing 2; and the lever 150 rotatably supported by the shaft 61 mounted on the main casing 2 at a position near the lower guiding groove 2*f* in the side wall 2*c*. When the lever 150 is rotated, the protruding part 155 provided on one end of the lever 150 protrudes into the lower guiding groove 2*f* and engages with the fixing boss 18*a* provided on the process cartridge 18, thereby preventing the process cartridge 18 from moving in a direction opposite the direction in which the cartridge 18 is mounted in the main casing 2.

The single lever 150 is attached to one end of the shaft 61. This construction of the lever 150 and the shaft 61 is simpler than a conceivable case where a pair of levers 150 are mounted on both ends of the shaft 61. Feewer parts are required in the main casing 2.

The process cartridge 18 receives a force restricting the process cartridge 18 from moving out of the image-forming position in a direction opposite the mounting direction at a location near the drive gear 45*b*. This reduces the torque generated by this force that attempts to rotate the process cartridge 18 in a plane parallel to the mounting direction. It is possible to effectively prevent the process cartridge 18 from rotating in a plane parallel to the mounting direction.

According to the present embodiment, the lever 150 engages with the protruding part 18*a* that protrudes from the side surface of the process cartridge 18 in a direction orthogonal to the mounting direction of the process cartridge 18. Construction of the process cartridge 18 according to this embodiment is simpler than a conceivable case where the lever 150 engages with a conceivable protruding part that protrudes from a front end surface of the process cartridge that faces a direction opposite the mounting direction. In addition, according to the present embodiment, the lever 150 can be provided near the side panel 2*c* of the casing 2 without interfering with other components.

The pinch roller shaft 11*a* can advance from or recede into the process cartridge 18 vertically. Hence, vertical movement of the process cartridge 18 while being mounted or removed along the guiding grooves is absorbed by the vertical advancing and receding of the pinch roller shaft 11*a*. Accordingly, the process cartridge 18 can be reliably mounted in the main casing 2 in a stable state.

The protruding part 18*a* engages with the lever 150 after the process cartridge 18 is guided along the guiding grooves 2*f* and 2*k* by the pinch roller shaft 11*a* to the image-forming position. Further, because the protruding part 18*a* is fixed on the side surface of the process cartridge 18, construction of the process cartridge 18 is simpler than a conceivable case where the protruding part 18*a* is fixed on the front surface of the process cartridge 18 facing a direction opposite the mounting direction.

The separating cam 83 is rotatably provided on the main casing 2 for engaging the developing roller 27 and the photosensitive drum 23 with each other and for separating the developing roller 27 and the photosensitive drum 23 from each other. In order to separate the developing roller 27 and the photosensitive drum 23 from each other, the separating cam 83 engages with the portion (bottom portion) of the process cartridge 18, which is defined in the vertical direction that intersects the mounting direction of the process cartridge 18. The engagement of the guiding groove 2*f* and the protruding part 18*a*, however, prevents the process cartridge 18 from moving or rising in the vertical direction that intersects the mounting direction. Accordingly, the mounting state of the processing cartridge 18 can be maintained stable.

The laser printer 1 includes: the main casing 2; the process cartridge 18 that can be mounted in or removed from an image-forming position in the main casing 2; the main casing cover 111 that opens and closes over the main casing 2; the protrusion-shaped contact members 51 and 52 disposed on the main casing cover 111; and the resilient tongue-shaped contact members 18*c* and 18*d* disposed near the bottom on the front surface of the process cartridge 18 and capable of contacting the protrusion-shaped contact members 51 and 52, respectively. When mounting the process cartridge 18 in the main casing 2, the main casing cover 111 is closed, pushing the process cartridge 18 into the image-forming position. When removing the process cartridge 18 from the main casing 2, the main casing cover 111 is opened, and the process cartridge 18 is removed along the guiding grooves 2*e* and 2*f* and 2*i* and 2*k*.

With this construction, the process cartridge 18 is pushed toward the image-forming position when the protrusion-shaped contact members 51, 52 provided on the main casing cover 111 contact the resilient contact members 18*c*, 18*d*. By using the resilient contact members 18*c*, 18*d* instead of some spring for guiding the process cartridge 18 to the image-forming position, it is unnecessary to press the process cartridge 18 with a force needed to overcome the urging force of the spring. Hence, the process cartridge 18 can be easily pushed to the image-forming position. Further, by not using a spring, the process cartridge 18 does not incur any resistance when removed from the main casing 2, thereby enabling the process cartridge 18 to be smoothly removed from the main casing 2.

The resilient contact members 18*c* and 18*d* are provided on the process cartridge 18. Hence, even if the resilient members become fatigued and damaged through many years of use, the damaged process cartridge is a consumable good that can be replaced with a new one.

With this construction, the main casing cover 111 pushes the process cartridge 18 in the mounting direction along the guiding grooves 2*e*, 2*f*, 2*i*, 2*k* formed in the main casing 2 for guiding the mounting and removal of the process cartridge. Accordingly, the process cartridge 18 can be smoothly pushed to the image-forming position.

With the protrusion-shaped contact members 51, 52 contacting the resilient contact members 18*c*, 18*d*, the main casing cover 111 pushes the process cartridge 18 in the mounting direction along: the horizontal terminal guiding grooves 2*g*, 2*j* to the image-forming position. The user pushes the main casing cover 111, which in turn pushes the process cartridge 18 to the image-forming position not dependent on the weight of the process cartridge 18. A user can push the process cartridge 18 along the horizontal terminal guiding grooves 2*g*, 2*j* toward the image-forming position with a single motion in a substantially horizontal direction. It is ensured that the user can easily mount the process cartridge 18 in the image-forming position.

Because the resilient tongue-shaped contact members 18*c* and 18*d* are provided on the front surface of the process cartridge 18, a mold for producing the process cartridge 18 can be easily created. Further, the widthwise dimension of the process cartridge 18 is made smaller than when providing the resilient contact members 18*c*, 18*d* on the side surfaces of the process cartridge 18, enabling the process cartridge 18 to be easily mounted in the main casing 2 without the resilient contact members 18*c*, 18*d* becoming caught by the main casing 2.

The main casing 2 is provided with the support shaft 57, which rotatably supports one end of the main casing cover 111. The protrusion-shaped contact members 51, 52 are disposed at a position that is located between the support shaft 57 and a free end of the main casing cover 111 and that opposes the resilient tongue-shaped contact members 18*c*, 18*d* when the process cartridge 18 is mounted in the main casing 2.

The engaging hooks 53 and the engaging pawls 55 engage the main casing cover 111 with the main casing 2 when the main casing cover 111 is closed on the main casing 2. The engaging hooks 53 are disposed on the main casing cover 111 at its free end and therefore is separated farther from the support shaft 57 than the protrusion-shaped contact members 51 and 52.

With this construction, the main casing cover 111 can be engaged with the main casing 2 when the main casing cover 111 is closed over the main casing 2 using the engaging hooks 53. Further, by providing the protrusion-shaped contact members 51, 52 at positions that oppose the resilient contact members 18*c*, 18*d*, which are provided on the lower end of the process cartridge 18, the distance from the support shaft 57 to the protrusion-shaped contact members 51, 52 can be minimized with respect to the predetermined positions of the resilient contact members 18*c*, 18*d*. Accordingly, the protrusion-shaped contact members 51, 52 need only rotate a short distance in the circumferential direction along with the rotation of the main casing cover 111. As a result, the resilient contact members 18*c*, 18*d* are resiliently displaced by only a small amount when pushed by the protrusion-shaped contact members 51, 52, thereby improving the durability of the resilient contact members 18*c*, 18*d*.

When the main casing cover 111 is closed, the engaging mechanism (53, 55) attains the engaged state shown in FIG. 9(*a*) and FIG. 9(*b*), in which the main casing cover 111 is engaged with the main casing 2. More specifically, when the main casing cover 111 is closed over the main casing 2, the protrusion-shaped contact members 51, 52 push the process cartridge 18 in the mounting direction while resiliently deforming the resilient contact members 18*c*, 18*d* until the engaging mechanism (53, 55) attains the engaged state. After the engaging mechanism (53, 55) attains the engaged state, the gap d is formed between the protrusion-shaped contact members 51, 52 provided on the main casing cover 111 and the resilient contact members 18*c*, 18*d* provided on the process cartridge 18 as shown in FIG. 9(*c*). Therefore, the protrusion-shaped contact members 51, 52 are separated from the resilient contact members 18*c*, 18*d*.

The engaging mechanism (53, 55) maintains the engaged state of FIG. 9(*a*) and FIG. 9(*b*) when the main casing cover 111 is being closed. The protrusion-shaped contact members 51, 52 are maintained in the separate state from the resilient contact members 18*c*, 18*d* as shown in FIG. 9(*c*) while the engaging mechanism (53, 55) maintains the engaged state. Because the protrusion-shaped contact members 51, 52 are separate from the resilient contact members 18*c*, 18*d*, it is possible to prevent vibrations generated on the main casing 2 side from being transferred to the process cartridge 18. As a result, the process cartridge 18 can easily be maintained in a fixed alignment. This construction also prevents stress from being continuously applied to the resilient contact members 18*c*, 18*d*.

The end part 53*a* of the engaging hook 53 provided on the main casing cover 111 contacts the end part 55*a* of the engaging pawl 55 when closing the main casing cover 111. From this position, when the main casing cover 111 is completely closed, the engaging pawl 55 slides over the end part 53*a* of the engaging hook 53 and engages in the engaging recess 53*b*, which is formed continuously with the hook end 53*a*, thereby enabling a reliable engagement between the engaging hook 53 and the engaging pawl 55.

The resilient contact members 18*c*, 18*d* are provided on the left and right ends of the process cartridge 18 so that the protrusion-shaped contact members 51, 52 contact the left and right ends of the process cartridge 18. Accordingly, a force is applied to the process cartridge 18 in a direction parallel to the direction the process cartridge 18 is inserted, avoiding the generation of a torque that could rotate the process cartridge 18 within a plane parallel to the plane of the insertion direction. As a result, the process cartridge 18 can be mounted in the main casing 2 in a stable state.

The line connecting the resilient contact members 18*c* and 18*d* is parallel to a horizontal direction when the process cartridge 18 is mounted in the main casing 2. It is possible to easily design the configuration of the resilient contact members 18*c* and 18*d* on the process cartridge 18. A force is applied to the process cartridge 18 in a direction parallel to the direction the process cartridge 18 is inserted, avoiding the generation of another torque that could rotate the process cartridge 18 within a plane orthogonal to the insertion direction. As a result, the process cartridge 18 can be mounted in the main casing 2 in a stable state.

The line connecting the pair of resilient contact members 18*c*, 18*d* provided on the left and right sides of the process cartridge 18 is parallel to the support shaft 57 when the process cartridge 18 is mounted in the main casing 2. Therefore, there is no difference in the magnitude of load transferred to the protrusion-shaped contact members 51, 52 from the left and right resilient contact members 18*c*, 18*d*.

Accordingly, it is possible to avoid the generation of torque that could bend the support shaft 57 in a plane parallel to the mounting direction of the process cartridge 18, thereby improving the durability of the main casing cover 111. Further, the insertion force applied to the process cartridge 18 is uniform on the left and right sides, enabling a stable mounting of the process cartridge 18.

Each protrusion-shaped contact member 51, 52 has a contact surface 51*a*, 52*a* that extends substantially vertically and that faces the corresponding resilient tongue-shaped contact member 18*c*, 18*d* when the process cartridge 18 is mounted in the main casing 2 and the main casing cover 11 is closed. Only a portion of the contact surface 51*a*, 52*a* contacts the corresponding resilient tongue-shaped contact member 18*c*, 18*d*. Durability of the protrusion-shaped contact member 51, 52 is enhanced.

When the contact surfaces 51*a*, 52*a* of the protrusion-shaped contact members 51, 52 come into contact with the contact surfaces 180*c*, 180*d* of the resilient contact members 18*c*, 18*d* as shown in FIGS. 8(*a*)-8(*c*), the main casing cover 111 is located at such a rotational angular position that the contact surfaces 51*a*, 52*a* of the protrusion-shaped contact members 51, 52 are in parallel with the contact surfaces 180*c*, 180*d* of the resilient contact members 18*c*, 18*d*.

The contact surfaces 51*a*, 52*a* of the protrusion-shaped contact members 51, 52 contact the contact surfaces 180*c*, 180*d* of the resilient contact members 18*c*, 18*d* in such a state that the contact surfaces 51*a*, 52*a* of the protrusion-shaped contact members 51, 52 are in parallel with the contact surfaces 180*c*, 180*d* of the resilient contact members 18*c*, 18*d*. It is possible to avoid a concentration of stress on any contact portion. Deformation of or damage to the protrusion-shaped contact members 51, 52 and the resilient contact members 18*c*, 18*d* can be avoided.

The process cartridge 18 can be mounted in and removed from the image-forming position by opening the main casing cover 111. When the main casing cover 111 is closed, the main casing cover 111 contacts the resilient contact members 18*c*, 18*d* provided on the process cartridge 18, thereby pushing the process cartridge 18 to the predetermined position in the image-forming device 1.

The space 18*i* is surrounded by the outer wall 18*j*. The space 18*i* receives the separating cam 83 for engaging the photosensitive drum 23 and the developing roller 27 with each other and for separating the photosensitive drum 23 and the developing roller 27 from each other. The space 18*i* opens in the vertical direction intersecting the direction in which the process cartridge 18 is mounted in the laser printer 1. The resilient contact members 18*c*, 18*d* are formed on the outer wall 18*j* at locations facing the space 18*i* in the form of tongue pieces, each of which is defined by a pair of slits 18*e*, 18*f*, 18*g*, 18*h* formed in the outer wall 18*j*. In this way, the space 18*i* is formed in the outer wall 18*j* of the process cartridge 18 for receiving the separating cam 83 therein and the resilient contact members 18*c*, 18*d* are formed on the outer wall 18*j*, facilitating the construction of a mold for producing the process cartridge 18.

While the invention has been described in detail with reference to the specific embodiment thereof, it would be apparent to those skilled in the art that various changes and modifications may be made therein without departing from the spirit of the invention.

For example, in the above-described embodiment, the protrusion-shaped contact members 51 and 52 are provided to the main casing cover 111, the resilient tongue-shaped contact members 18*c* and 18*d* are provided to the process cartridge 18, the lever 150 is provided in the main casing 2. However, if the lever 150 is provided in the main casing 2, the protrusion-shaped contact member 51 or 52 may not be provided to the main casing cover 111 and the resilient tongue-shaped contact member 18*c* or 18*d* may not be provided to the process cartridge 18. On the other hand, if the protrusion-shaped contact members 51 and 52 are provided to one of the main casing cover 111 and the process cartridge 18 and the resilient tongue-shaped contact members 18*c* and 18*d* are provided to the other one of the main casing cover 111 and the process cartridge 16, the lever 150 may not be provided in the main casing 2.

The engaging hook 53 may not be provided to the main casing cover 111, and the engaging pawl 55 may not be provided to the top cover 2*q*.

What is claimed is:

1. An image-forming device comprising:

a main casing; a main casing cover attached to the main casing;

a process cartridge having a photosensitive body and capable of being mounted in and removed from an image-forming position defined inside the main casing;

a cartridge gear disposed on the process cartridge and provided to the photosensitive body;

a drive gear disposed on the main casing and capable of engaging with the cartridge gear to transfer a driving force to the cartridge gear; and a restricting portion provided on the main casing and capable of switching between a restricting position and a non-restricting position, the restricting portion at the restricting position restricting the process cartridge from moving out of the image-forming position in a direction opposite a mounting direction when the drive gear engages with the cartridge gear to transfer a driving force to the cartridge gear, and the restricting portion at the non-restricting position canceling the restriction of movement on the process cartridge.

2. An image-forming device according to claim 1, further comprising an operating portion that switches the restricting portion between the restricting position and the non-restricting position.

3. An image-forming device according to claim 1, wherein the main casing has a front panel at one side, the front panel extending vertically and facing a direction opposite the mounting direction, an opening being formed in the front panel for receiving the process cartridge, the opening being exposed and covered by the main casing cover.

4. An image-forming device according to claim 3, wherein the main casing has a guiding groove extending from the opening to the image-forming position to guide the process cartridge from the opening to the image-forming position, the guiding groove extending linearly to allow the process cartridge to be mounted by a single operation in the mounting direction.

5. An image-forming device according to claim 1, further comprising a main casing cover attached to the main casing, the main casing cover being capable of opening over the main casing, thereby allowing the process cartridge to be mounted in or removed from the main casing, the main casing cover being capable of closing over the main casing;

wherein the restricting portion is switched to the non-restricting position when the main casing cover is opened and to the restricting position when the main casing cover is closed.

6. An image-forming device according to claim 5, wherein one of the process cartridge and the main casing cover is provided with one of a protrusion-shaped contact member and a resilient contact member capable of contacting the protrusion-shaped contact member, and the other one of the process cartridge and the main casing cover is provided with the other one of the protrusion-shaped contact member and the resilient contact member, the protrusion-shaped contact member contacting the resilient contact member when the main casing cover is closed, pushing the process cartridge into the image-forming position.

7. An image-forming device according to claim 6, wherein the main casing cover has the protrusion-shaped contact member, and the process cartridge has the resilient contact member capable of contacting the protrusion-shaped contact member.

8. An image-forming device according to the claim 7, wherein guiding grooves are formed in both side surfaces of the main casing for guiding the process cartridge as the process cartridge is mounted into the main casing or removed from the main casing.

9. An image-forming device according to claim 8, wherein terminal guiding grooves are formed in the both side surfaces of the main casing at ends of the guiding grooves to extend in the horizontal direction, and the main casing cover pushes the process cartridge along the terminal guiding grooves to the image-forming position with the protrusion-shaped contact member contacting the resilient contact member.

10. An image-forming device according to claim 7, wherein the resilient contact member is provided on a lower end of a surface of the process cartridge that faces the direction opposite the mounting direction.

11. An image-forming device according to claim 10, wherein the main casing is provided with a support shaft rotatably supporting one end of the main casing cover; and the protrusion-shaped contact member is disposed at a position that is located between the support shaft and a free end of the main casing cover and that opposes the resilient contact member when the process cartridge is mounted in the main casing.

12. An image-forming device according to claim 11, further comprising an engaging mechanism that engages the main casing cover with the main casing when the main casing cover is closed on the main casing;

wherein a portion of the engaging mechanism that is capable of engaging with the main casing is disposed on the free end of the main casing cover and is separated farther from the support shaft than the protrusion-shaped contact member.

13. An image-forming device according to claim 7, further comprising an engaging mechanism that attains an engaged state in which the main casing cover is engaged with the main casing when the main casing cover is closed, the engaging mechanism maintaining the engaged state when the main casing cover is being closed;

wherein the protrusion-shaped contact member pushes the process cartridge in the mounting direction while resiliently deforming the resilient contact member until the engaging mechanism attains the engaged state; and the protrusion-shaped contact member separating from the resilient contact member after the engaging mechanism attains the engaged state and while the engaging mechanism maintains the engaged state.

14. An image-forming device according to claim 13, wherein the engaging mechanism comprises:

an engaging hook provided on the main casing cover and having a hook end and an engaging recess formed continuously with the hook end; and an engaging pawl provided on the main casing and capable of sliding over the hook end of the engaging hook and engaging with the engaging recess.

15. An image-forming device according to claim 7, wherein a pair of resilient contact members are respectively provided on a pair of opposite ends of the process cartridge defined along a direction orthogonal to the mounting direction.

16. An image-forming device according to claim 15, wherein a line connecting the pair of resilient contact members is parallel to a horizontal direction when the process cartridge is mounted in the main casing.

17. An image-forming device according to claim 16, wherein the main casing is provided with a support shaft rotatably supporting the main casing cover, the line connecting the pair of resilient contact members being parallel to the support shaft when the process cartridge is mounted in the main casing.

18. An image-forming device according to claim 7, wherein the protrusion-shaped contact member has a contact surface that faces the resilient contact member when the process cartridge is mounted in the main casing and the main casing cover is closed, a portion of the contact surface contacting the resilient contact member.

19. An image-forming device according to claim 7, wherein when the contact surface of the protrusion-shaped contact member comes into contact with the contact surface of the resilient contact member, the main casing cover is located at a rotational angular position that allows the contact surface of the protrusion-shaped contact member is in parallel with the contact surface of the resilient contact member.

20. An image-forming device according to claim 7, wherein the protrusion-shaped contact member is substantially of a rectangular shape with rounded edges.

21. An image-forming device according to claim 6, wherein the main casing comprises a front panel formed with an opening, through which the process cartridge is inserted into and removed from the main casing, the front panel intersecting with the mounting direction of the process cartridge.

22. The image forming device according to claim 1, wherein the drive gear has a rotational shaft, the mounting direction being orthogonal to the rotation shaft.

23. An image-forming device comprising:

a main casing having a pair of side walls, an image-forming position being defined in the main casing between the pair of side walls;

a process cartridge having a photosensitive body and capable of being mounted in or removed from the image-forming position, the process cartridge further having a cartridge gear that is provided on the process cartridge to drive the photosensitive body;

a main casing cover that is attached to the main casing and is capable of opening and closing over the main casing, the main casing cover opening over the main casing to allow the process cartridge to be mounted in and removed from the main casing;

a drive gear that is provided on the main casing and that is capable of engaging with the cartridge gear and rotating in forward and reverse directions for transferring a driving force to the cartridge gear;

guiding grooves being formed in the side walls of the main casing, each guiding groove being formed in a corresponding side wall, each guiding groove guiding the process cartridge to the image-forming position to mount the process cartridge to the image-forming position, each guiding groove guiding the process cartridge to be removed from the image forming position outside the main casing; and a lever supported on the main casing and disposed adjacent to one guiding groove on at least one side wall, the lever having a restricting portion capable of being switched between a restricting position and a non-restricting position, the restricting portion being at the restricting position when the main casing cover is in a closed state, the restricting portion at the restricting position restricting the process cartridge from moving out of the image-forming position in a direction opposite a mounting direction when the drive gear rotates in the reverse direction, and the restricting portion at the non-restricting position canceling the restriction of movement on the process cartridge.

24. An image-forming device according to claim 23, wherein the drive gear rotates in the forward direction during image formation, thereby allowing the process cartridge in the image-forming position to receive a force to move the process cartridge in the mounting direction.

25. An image-forming device according to claim 23, further comprising a shaft provided in the main casing, the lever being attached to one end of the shaft.

26. An image-forming device according to claim 23, further comprising a link that is connected to one end of the lever and that opens and closes the main casing cover, the lever moving in association with the main casing cover.

27. An image-forming device according to claim 23, wherein the lever is disposed adjacent to the guiding groove provided on one side wall of the main casing, the drive gear being provided at a position nearer to the one side wall than to the other side wall.

28. An image-forming device according to claim 23, wherein the main casing has a front panel facing a direction opposite the mounting direction of the process cartridge, an opening being formed in the front panel, the process cartridge being mounted through the opening into the main casing.

29. An image-forming device according to claim 23, wherein the process cartridge includes a protruding part that protrudes from both side surfaces of the process cartridge in a direction orthogonal to the mounting direction of the process cartridge and that is received in the guiding grooves when the process cartridge is mounted in the main casing;

wherein the restricting portion at the restricting position engages with the protruding part on at least one side of the process cartridge.

30. An image-forming device according to claim 29, wherein the process cartridge includes a pinch roller shaft that advances out of or recedes into the process cartridge in a vertical direction, the pinch roller shaft being guided along the guiding grooves.

31. An image-forming device according to claim 30, wherein the protruding part is disposed upstream of the pinch roller shaft with respect to the mounting direction of the process cartridge and is fixed to the side surface of the process cartridge.

32. An image-forming device according to claim 29, wherein the lever forms a portion of the one guiding groove for guiding the protruding part when the restricting portion is in the non-restricting position.

33. An image-forming device according to claim 29, wherein the process cartridge further comprises a developing portion accommodated therein for developing electrostatic latent images on the photosensitive body; and further comprising a separating cam rotatably disposed on the main casing for separating the developing portion and the photosensitive body from each other, the separating cam being capable of engaging with a portion of the process cartridge;

wherein the process cartridge is restricted from moving in a direction intersecting the mounting direction by the engagement of the guiding grooves and the protruding part when the separating cam engages with the portion of the process cartridge.

34. An image-forming device according to claim 33, wherein the lever is attached to a shaft supporting the separating cam.

35. An image-forming device according to claim 34, further comprising a bearing mounted on one side wall and rotatably supporting an end of the shaft opposite another end on which the lever is mounted, the bearing having a top surface shaped to form part of the bottom surface of the guiding groove.

36. An image-forming device according to claim 23, wherein one of the process cartridge and the main casing cover is provided with one of a protrusion-shaped contact member and a resilient contact member capable of contacting the protrusion-shaped contact member, and the other one of the process cartridge and the main casing cover is provided with the other one of the protrusion-shaped contact member and the resilient contact member, the protrusion-shaped contact member contacting the resilient contact member when the main casing cover is closed, pushing the process cartridge into the image-forming position.

37. An image-forming device according to claim 36, wherein the main casing cover has the protrusion-shaped contact member, and the process cartridge has the resilient contact member capable of contacting the protrusion-shaped contact member.

38. The image forming device according to claim 23, wherein the drive gear has a rotational shaft, the mounting direction being orthogonal to the rotation shaft.

* * * * *